US009792772B2

(12) United States Patent
Lund

(10) Patent No.: US 9,792,772 B2
(45) Date of Patent: Oct. 17, 2017

(54) SYSTEMS AND METHODS FOR ALLOWING PLAYERS TO PLAY POKER GAMES HAVING MULTIPLE DECKS

(71) Applicant: Formatfabriken STHLM idé och skrivbrå, Hollviken (SE)

(72) Inventor: Kim Lund, Hollviken (SE)

(73) Assignee: FORMATFABRIKEN STHLM IDÉ OCH SKRIVBRÅ, Hollviken (SE)

( * ) Notice: Subject to any disclaimer, the term of this patent is extended or adjusted under 35 U.S.C. 154(b) by 773 days.

(21) Appl. No.: 14/172,514

(22) Filed: Feb. 4, 2014

(65) Prior Publication Data

US 2014/0221070 A1 Aug. 7, 2014

Related U.S. Application Data

(60) Provisional application No. 61/760,543, filed on Feb. 4, 2013.

(51) Int. Cl.
*G07F 17/32* (2006.01)

(52) U.S. Cl.
CPC ..... *G07F 17/3293* (2013.01); *G07F 17/326* (2013.01)

(58) Field of Classification Search
CPC ..... G07F 17/326; G07F 17/3293
See application file for complete search history.

(56) References Cited

U.S. PATENT DOCUMENTS

| | | | | |
|---|---|---|---|---|
| 5,042,818 | A | 8/1991 | Weingardt | |
| 5,662,332 | A * | 9/1997 | Garfield | A63F 1/00 273/308 |
| 5,752,702 | A * | 5/1998 | McDoniel | A63F 3/00157 273/292 |
| 6,254,099 | B1 * | 7/2001 | Pederson | A63F 3/00075 273/262 |
| 6,375,566 | B1 * | 4/2002 | Yamada | A63F 1/00 273/308 |
| 7,540,499 | B2 | 6/2009 | Webb | |
| 7,717,783 | B2 | 5/2010 | Pfeiffer et al. | |
| 2002/0193157 | A1 * | 12/2002 | Yamada | A63F 13/005 463/9 |
| 2005/0054402 | A1 * | 3/2005 | Noguchi | A63F 13/10 463/5 |

(Continued)

FOREIGN PATENT DOCUMENTS

CA 2 464 498 A1 10/2005

*Primary Examiner* — Tramar Harper
(74) *Attorney, Agent, or Firm* — Howard & Howard Attorneys PLLC

(57) ABSTRACT

A system for providing a poker-type card game to a plurality of players is described herein. The system includes a display device for displaying the game, a database for storing a plurality of player decks, and a controller coupled to the database. The controller is configured to provide a plurality of player decks with each of the plurality of player decks including a set of randomly-ordered playing cards, assign a player deck of the plurality of player decks to each of the plurality of players, and conduct a first round of the game. During a round, the controller distributes a player hand to each of the plurality of players. Each of the player hands includes one or more cards being distributed from a corresponding player deck assigned to the player.

20 Claims, 9 Drawing Sheets

(56) References Cited

U.S. PATENT DOCUMENTS

| | | | | |
|---|---|---|---|---|
| 2007/0063442 | A1* | 3/2007 | Kenny | A63F 3/00157 273/292 |
| 2008/0039167 | A1* | 2/2008 | Harris | G07F 17/32 463/8 |
| 2008/0067743 | A1* | 3/2008 | Naicker | A63F 1/10 273/292 |
| 2008/0157474 | A1* | 7/2008 | Au-Yeung | A63F 3/00157 273/292 |
| 2008/0300034 | A1* | 12/2008 | Savage | G07F 17/3202 463/11 |
| 2010/0184501 | A1 | 7/2010 | Pfeiffer et al. | |
| 2012/0302321 | A1* | 11/2012 | Bowen | G07F 17/3293 463/22 |

* cited by examiner

| | |
|---|---|
| Game Round | 2 |
| Deck Strength | 50 |
| No. of Cards | 25 |
| No. of Face Cards | 15 |
| No. of Suited Cards | 9 – Hearts<br>10 - Diamonds<br>2 - Spades<br>1 – Clubs<br>3 – Wilds |

| Player Deck | | Probability of Achieving Card Hand | | | | | | |
|---|---|---|---|---|---|---|---|---|
| Deck No. | Deck Strength | No. of Cards | Pocket Pair | Suited Cards | Flush | Suited Jacks or higher | Straight | Full House |
| Deck 1 | 50 | 52 | 6% | 24% | 0.3% | 2% | 3% | 4% |
| Deck 2 | 80 | 45 | 8% | 30% | 0.5% | 2% | 3% | 4% |
| Deck 3 | 85 | 50 | 6% | 30% | 1.2% | 5% | 4.5% | 6% |

| | |
|---|---|
| Deck Strength | 85 |
| No. of Cards | 25 |
| No. of Face Cards | 15 |
| No. of Suited Cards | 10- Hearts<br>10 - Diamonds<br>0 - Spades<br>0 – Clubs<br>5 – Wilds |

SYSTEMS AND METHODS FOR ALLOWING PLAYERS TO PLAY POKER GAMES HAVING MULTIPLE DECKS

CROSS REFERENCE TO RELATED APPLICATION

This application claims the benefit of U.S. Provisional Patent Application Ser. No. 61/760,543, filed Feb. 4, 2013, the disclosure of which is hereby incorporated by reference in its entirety for all purposes.

COPYRIGHT NOTICE

The figures included herein contain material that is subject to copyright protection. The copyright owner has no objection to the facsimile reproduction by anyone of this patent document as it appears in the U.S. Patent and Trademark Office, patent file or records, but reserves all copyrights whatsoever in the subject matter presented herein.

TECHNICAL FIELD

The subject matter disclosed herein relates generally to a system for allowing players to play poker-type games and more particularly, to methods and systems for allowing players to play poker-type games that include multiple decks of playing cards including a playing card deck assigned to each of the players.

BACKGROUND OF THE INVENTION

Wagering games, such as Blackjack and Texas Hold'em poker, are very popular with players. While many games currently exist, additional games and variations of existing wagering games are always of interest to players and gaming operators to maintain player interest, among other things. At least some known systems allow a plurality of players to play online poker-type games via a plurality of client devices that are connected together via the internet. During play of known online poker-type games, each player is dealt a hand including a set of cards being dealt from a common deck of playing cards, and places wagers based on the associated dealt hand. At least some known poker-type games include an additional community hand that is also dealt from the common deck and includes a set of community cards that may be used by each of the players to form a poker hand.

The game of poker is well known and the rules can be found in nearly every card game rule book. In the game of poker cards are dealt to each player. Players may have a chance to improve their hand by discarding some of their cards, and receiving replacements, as in draw poker, or more cards may be dealt than needed and the best cards retained, as in the seven-card variations of poker. Other forms like Texas Hold'em and Omaha requires the use of communal "board cards" that are shared by all players.

Various rounds of betting take place after dealing and after drawing. In five-card stud poker, one card is dealt face down and the four remaining cards are dealt face up one at a time with a round of betting after each face up card is dealt. In all variations of poker, when the betting rounds are completed, the remaining players expose their hands and the winning player collects the money bet. The outcome is determined by the combinations of cards in the exposed hands. Those combinations are well known—high card, one pair, two pair, three-of-a-kind, straight, flush, full house, four-of-a-kind, and straight flush—and are described in nearly every card game rule book.

For example, at least some known poker-type game such as, for example, "Texas Hold 'Em" provide each player two cards dealt face down from the common deck, after which five community cards are dealt face up from the common deck. Each player's hand is determined based on two, one or none of the player's dealt cards and three, four or all five of the five community cards. Betting rounds may occur after each player receives the two cards, after the third community card has been dealt (called the "flop"), after the fourth community card has been dealt (the "turn"), and after the fifth community card has been dealt (the "river"). In addition, antes and/or blinds may be required to bet a predefined fixed amount into a "pot" in order to participate in the round and prior to the cards being dealt. Any amount included in the "pot" may be distributed to the player having a winning card hand. During each betting round, each player may decide to remain in the round by placing and/or checking a bet or to leave the round by relinquishing any bets to the "pot" and "folding" their card hand. At the completion of each betting round, each of the remaining player displays the player's two dealt cards in a "showdown", and the value of each remaining player's hand is determined based on the player's two cards and three of the five community cards to form a five card poker hand, with the poker hands being ranked in standard poker fashion, such as, for example, royal flush, straight flush, four of a kind, full house, flush, straight, three of a kind, two pair, one pair, and high card, in descending order. The player having the highest poker hand is the game winner.

A problem with traditional poker games is that the constant reshuffling of playing cards back into the deck between each round of play can lead to a very uneven distribution of good cards. It may take several hundred hands before players can be reasonably certain that they have not been disfavored by the random draw. They can keep being dealt the same bad cards over and over again. Another problem is that the skillful art of reading opponent's hand (essentially using all available information like prior plays, betting patterns, body language and more to analyze what cards the opponent may be holding) requires a significant amount of prior history to be effective. So hand reading becomes a historical rather than a situational affair. Both these issues prevent the game from being played as a skill game in the short-term.

Over time, during game play, the player may become frustrated because the chances of achieving a winning poker hand are based only on the cards available form the common deck. Accordingly, new features are necessary to appeal to player interest and enhance excitement in order to entice longer play and increased profitability. Thus, there continues to be a need for new games to compete with or replace the most popular games being played today. The present invention is directed to satisfying these needs.

SUMMARY OF THE INVENTION

The invention is generally directed to systems and methods for allowing players to play poker-type games including multiple decks, assigning each player a corresponding deck, and allowing each player some capacity to modify the assigned player deck to increase a probability of achieving a winning poker hand.

In one aspect of the invention, a method of playing computerized card games against real or virtual players is provided. Where traditional poker games are played using one communal deck of card where cards played that hand are reshuffled back into the deck between each round of play (known as "a hand")—potentially leading to a very uneven distribution of cards between players—this method of playing introduces the use of multiple decks of cards where played cards are not reshuffled back into the deck between hands. Instead of being dealt cards from a constantly reshuffled communal deck, players all have their own decks from which they randomly draw cards. Played cards are temporarily removed from the game until one of several possible events causes one or several cards to re-introduced into the game—for example through a reshuffle. This invention guarantees that all players will be dealt cards from a pre-set pool of cards where the risk of repeatedly being dealt the same combinations of cards with a lower probability of winning is reduced—thus removing a significant element of luck that otherwise governs the game of poker. In the event of the innovation being applied to a set of poker rules requiring the use of "board cards" (cards played face-up on the table and shared by all players) the board cards will be drawn from a separate deck that is reshuffled between each round of play. The mechanisms used to determine how cards are dealt in order to (a) avoid duplicate cards in play and to (b) trigger the reintroduction of a player's card or cards into play are part of the innovation.

In one aspect of the invention, a system for providing a poker-type card game to a plurality of players is provided. The system includes a display device for displaying the game, a database for storing a plurality of player decks, and a controller coupled to the database. The controller is configured to provide a plurality of player decks with each of the plurality of player decks including a set of randomly-ordered playing cards, assign a player deck of the plurality of player decks to each of the plurality of players, and conduct a first round of the game. During the first round, the controller distributes a first player hand to each of the plurality of players. Each of the first player hands includes one or more cards being distributed from a corresponding player deck assigned to the player. The controller receives a wager from each of the players and determines an outcome of the first round as a function of each of the first player hands and provides an award to at least one of the players as a function of the received wagers and the outcome.

In another aspect of the invention, a method for providing a poker-type card game to a plurality of players is provided. The method includes providing a plurality of player decks with each of the plurality of player decks including a set of randomly-ordered playing cards, assigning a player deck of the plurality of player decks to each of the plurality of players, and conducting a first round of the game. The method also includes distributing a first player hand to each of the plurality of players. Each of the first player hands including one or more cards being distributed from a corresponding player deck assigned to the player. The method also includes receiving a wager from each of the players, determining an outcome of the first round as a function of each of the first player hands, and providing an award to at least one of the players as a function of the received wagers and the outcome.

In yet another aspect of the invention, one or more non-transitory computer-readable storage media, having computer-executable instructions embodied thereon is provided. The computer-executable instructions, when executed by at least one processor, cause the processor to display a game on a display device, provide a plurality of player decks with each of the plurality of player decks including a set of randomly-ordered playing cards, assign a player deck of the plurality of player decks to each of the plurality of players, and conduct a first round of the game. The processor also distributes a first player hand to each of the plurality of players with each of the first player hands including one or more cards being distributed from a corresponding player deck assigned to the player, receives a wager from each of the players, determines an outcome of the first round as a function of each of the first player hands, and provides an award to at least one of the players as a function of the received wagers and the outcome.

BRIEF DESCRIPTION OF THE DRAWINGS

Other advantages of the invention will be readily appreciated as the same becomes better understood by reference to the following detailed description when considered in connection with the accompanying drawings wherein.

Corresponding reference characters indicate corresponding parts throughout the drawings.

DETAILED DESCRIPTION OF THE PREFERRED EMBODIMENT

Figure 1:
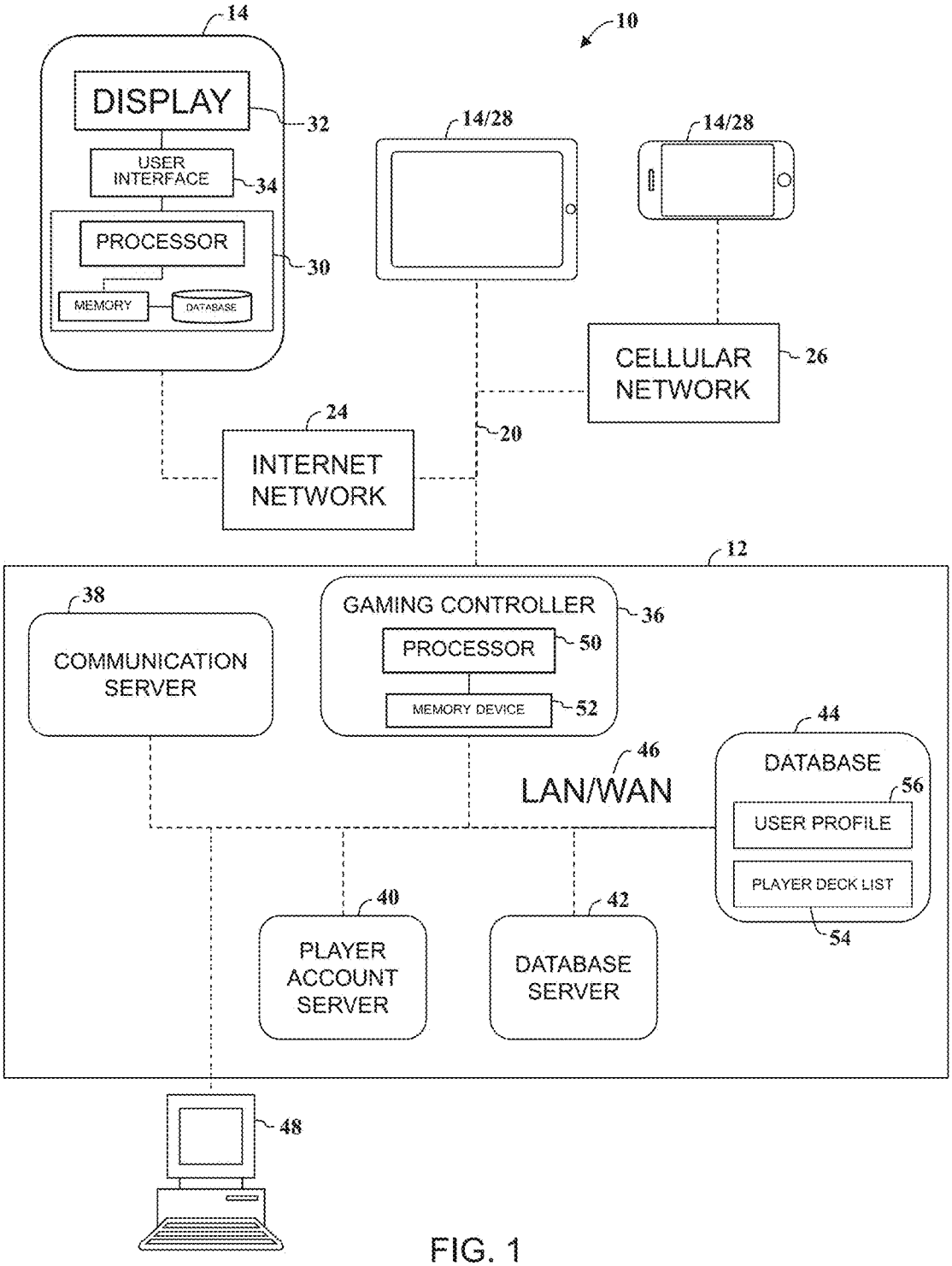
FIG. 1 is a schematic representation of an exemplary system for allowing a player to play a poker-type game via a user computing device, according to an embodiment of the invention.

The invention is generally directed to wagering games in which a final outcome is based on one or more random outcomes, which may be generated by physical means, such as through the use of randomly ordered or shuffle playing cards, or through computerized means, such as via a random number generator or software program for providing random results.

In some embodiments, the invention is directed to methods and systems of providing multiplayer poker games using multiple decks, including the non-limiting, exemplary embodiment described herein below and also referred to as "Limited Deck Poker," generally involving a multiplayer poker game where players, instead of being dealt playing cards ("the hole cards") from a single deck of cards ("a deck"), are dealt cards from individual decks of cards ("player decks"). Communal cards ("the board cards"), if any, are also dealt from a separate deck of cards ("the board deck"). Where the normal procedure, when a single deck is used, is to put all cards used during a round of play ("a hand") back in the deck after the completion of a round of play; in this game, players' played cards are removed from each player's deck. Removed cards will remain out of play during future rounds until a specified condition is met upon which some or all removed cards are brought back into play. Any dealt board cards will be put back into the board card deck after each round of play and is then reshuffled. Board cards are not out of play during future rounds.

With reference to the drawings and in operation, the present invention overcomes at least some of the disadvantages of known systems by providing a system that allows a plurality of players to play a poker-type game that includes a plurality of player decks, with each player deck being assigned to a different player, and each player hand including playing cards being distributed from each assigned player deck. In addition, the system may distribute each player hand to include different cards by determining if a card being dealt to a corresponding player matches a card previously dealt to another player during the same hand. In this scenario, to avoid duplicate cards in play, the system may continue to randomly draw cards from the player's deck until a not previously dealt card is drawn, which is then dealt to the player. Moreover, the system may also modify each of the player decks after each round by removing the previously played player hands from each of the assigned player decks. By modifying each player deck to remove previously played hands, the system adjust the probability of achieving winning poker hands associated with each player deck for each round of the game. Thus increasing the excitement and interest of each of the players and increasing the amount of time that the game is played by patrons of a gaming establishment.

In general, the present invention is directed to a system 10 that is configured to perform some or all of the following features:

(1) a method of playing a multiplayer card game where players are dealt cards from individual decks of cards instead of from a single shared deck. This includes the use of separate deck of cards from which to draw communal or shared cards.

(2) a method of playing a player versus player multiplayer poker game with multiple decks of cards where already played cards from players' individual decks are removed from their source decks after the completion of a round of play and will remain out of play during future rounds of play until a pre-determined condition, like, but not limited to, a deck running out of cards, is met and the decks are reassembled.

(3) a method of playing a player versus player multiplayer poker game with multiple decks where the randomly dealt cards from one deck affect the drawing of cards from other decks by disallowing a card of the same value and suit as a card already dealt from one player's personal deck during a round of play from being put into play by another player's deck, or the board deck, during the same round of play.

(4) a method of playing a player versus player multiplayer poker game with multiple decks whereupon any of the used decks of cards may diverge from the standard 52 card deck arrangement (fourteen cards, two to ace, in four different suits, hearts, clubs, spades and diamonds) and where one deck may be composed of a different arrangement of cards than other decks used during the same round of play.

Description of Limited Deck Poker.

In the illustrated embodiment, the system 10 may be configured to provide a poker-type game such as, for example "Limited Deck Poker". Limited Deck Poker is a game based on traditional player versus player poker rules and can be applied to several existing variations of poker such as, but not limited to, Texas Hold'em and Omaha. The game is designed to be used in any competition form, such as standard poker tournaments formats like Sit & Go tournaments, where the result of the game is based on the cumulative outcome of a series of play rounds known as hands. The invention changes core rules related to the availability of cards and the process of dealing those cards and also introduces rules not covered by standardized poker rules such as the arrangement of decks used for playing. The end effect is a game that while familiar to anyone accustomed to playing player versus player poker, drastically changes the strategy of the game.

The game is predominately designed to be used in a digital medium. Exemplary mechanics of the game are:

(a) The use of individual decks. Each player draws his starting cards from a personal deck. Board cards are also drawn from a separate deck.

(b) The removal of already played cards from players' decks until one or several possible predetermined conditions are met and a deck is fully or partially reassembled.

(c) A method of preventing identical cards to be drawn from different decks during the same round of play.

(d) The possibility for players to use decks arranged differently from the standard 52 card (14 values times 4 suits) arrangement and different from other decks used by other players during the same round of play.

Limited Deck Poker may be implemented and played as follows:

1. A game of Limited Deck Poker begins with a predetermined number of players, two to eight players is recommended, being assigned a position in relation to the other players. This is referred to as "a table".

2. Each player at the table is either assigned a standard 52 card deck, get to choose from number of different pre-composed decks or use their own decks composed based on a series of criteria.

3. Play begins as a normal poker game with the order of play being determined by the random pick of a "dealer" and the forced payment of bets as stipulated by the blinds and ante structure applied to the competition format chosen for the table.

4. The player to the left of the dealer is drawn a random card from his deck. The process continues clockwise with each player receiving cards from his or her deck until each player has been dealt the number of starting cards stipulated by the played poker variation. This is called a dealing cycle.

There may be different dealing cycles that can be applied to the game, two of which are provided below:

a. In the first variant of the dealing cycle, players cannot be dealt the same cards during the same round of play. This variant is designed to be used in a digital medium. The software will note each card dealt and prohibit all dealt cards from being dealt again from another deck later in the same dealing cycle.

b. In the second variant of the dealing cycle, no such restrictions apply. Players may end up playing the same cards during the same round of play.

For each card dealt during the dealing cycle a check is made to see if a predetermined condition, a reassembly trigger, has been met. If it has, then all or some cards that are out of play are reinstated back into their decks and are available to be dealt again. There are four different categories of reassembly triggers that can be applied to a game.

They can be combined and applied hierarchically but some cannot be combined with either of the available dealer cycles.

a. Decks, minus cards already dealt from each deck during the current dealing cycle, will reassemble and be reshuffled as soon as a pre-determined card is dealt during the dealing cycle. Applicable to dealing cycle one and two.

b. Decks, minus cards already dealt from each deck during the current dealing cycle, will reassemble and be reshuffled once all the cards that remain in a deck that is next to deal a card are blocked from being dealt due to already having been dealt during the dealing cycle. Applicable to dealing cycle one.

c. Decks, minus cards already dealt from each deck during the current dealing cycle, will reassemble and be reshuffled as soon as a deck scheduled to deal a deck no longer has any cards left. Applicable to dealing cycle one and two.

d. Decks, minus cards already dealt from each deck during the current dealing cycle, will reassemble and be reshuffled when a player uses an awarded right, represented by a digital or physical reassembly trigger token, to request it. The awarded right may cover all discarded cards and all decks or just a subset of discarded cards (like for example a specific card) and may only apply to selected decks. Applicable to dealing cycle one and two.

5. This is called the discard phase. If the poker variation chosen for the table requires cards to be discarded after the dealing cycle has been completed, this is the time. There are two alternative methods for handling the discard phase that can be applied for the game played.

a. In the first alternative, any discarded cards are reshuffled back into each player's deck.

b. In the second alternative, any discarded cards are removed from play until a reassembly trigger condition is met.

6. Standard rounds of betting followed by a showdown commence according to the rules stipulated by the poker variation played. If those rules require communal cards (board cards) to be dealt prior to, in between or after a round of betting, such cards are drawn from a separate deck of cards referred to as the board deck. There are two variations on the rule controlling the behavior of the board deck.

a. In the first variation, the board deck uses available data from the dealing cycle to avoid dealing board cards identical in value and suit to any of the cards dealt during the dealing cycle.

b. In the second variation the board deck deals communal cards according to standard board card dealing practices. If any of the dealt board cards matches a card dealt to a player, that communal card, for that player, becomes a wild card that at a showdown can be chosen to represent any card in a deck not held by that player, or held by other players participating in the showdown. In case of a wild card playing player proclaiming his best hand during a showdown based on his wild card representing a card that it turns out is held by a player that reveals that card later during the showdown procedure; then the wild card is voided and counts as a blank card with no value or suit.

7. After the hand is over, all cards played or folded by players during the round are kept in separate mucks and are temporarily removed from play. Cards associated with one player must not be mixed up with the cards associated with another player.

8. After a winner has been determined according to standard hand strength rules for the chosen game variation, the stakes and conditions of play, such as the levels of blind bets and antes, are adjusted according to the rules stipulated by the chosen competition format. The board deck is reassembled and shuffled. Player decks, minus already played cards, are also reshuffled.

9. The next round of play begins with the player to the left of the dealer during the last round being assigned as the dealer. A new dealer cycled commences with the first card being randomly drawn by the player to the left of the dealer from his personal deck.

Some embodiments of the invention are also directed to methods and systems of constructing decks from standard playing cards for use in poker, including the non-limiting, exemplary embodiment described herein which involves some or all of the following features:

(1) an algorithm that calculates the total strength of a composed deck by assigned each deck construction a "deck strength value";

(2) a method for how to, based on a predetermined total deck strength value and values assigned to each standard playing card plus a wild card, remove and add individual cards in order to construct a deck; and (3) a digital tool for facilitating the construction of decks according to the above method.

In one embodiment, the system 10 provides a method for constructing decks for playing poker using standard playing cards and for measuring the strength of a constructed deck in comparison to a standard 52 card deck. The embodiment also encompasses instructions for how to create a digital tool for choosing which cards to include in a deck, display (a) the current strength of a deck (b) the increase or decrease in the total strength of a deck should a specific card be added to or removed from a deck. The tool also allows a user to set certain restrictions for how decks can be created such as setting a maximum strength value for a deck, preventing duplicate cards or individual cards from being picked and requiring a minimum amount of cards to be picked.

In one embodiment, the system 10 may include the following features:

1. A method, in the form of an algorithm, for determining the strength of a constructed deck of cards based on all or a selection of the following variables: Individual card strength. In poker, each card has a ranking based either solely on its value (ace being the strongest and a deuce the weakest) or alternately, depending on the poker variation played, also its suit (spade being the strongest followed by hearts, diamonds and clubs). Relationship to other cards in the deck. The strength of a card in a deck used for multi-player poker cards increases (1) the more cards of the same suit that is in the deck measured as a percentage of the total number of cards in the deck and (2) the number of cards connected to the card in question by being either being of the same value or just above or just below the card in value. The chosen poker variation.

2. A method for presenting the current strength of a constructed deck in the form of a deck strength value.

3. A method for assigning a card strength value to all 52 standard playing cards plus a wild card based on each card's value and suit and the current composition of any composition of a deck already underway should that card be added to the deck.

4. A method for adding and subtracting cards to a deck and displaying the deck strength effect of each addition or removal.

5. A method for adding cards of the same rank and suit as cards already assigned to a deck.

6. A method for limiting cards that can used to construct a deck according to any or a combination of several of the following rules: A deck must contain a predetermined minimum amount of cards. A deck must not contain multiple cards of the same rank and suit. A deck must contain the same number of cards from each suit. A deck must not have a deck strength value that that exceeds a predetermined amount. A deck must not exceed a predetermined maximum of cards. A deck must not contain any of a number of specifically excluded cards. A deck must not contain more than a predetermined number of cards of the same value. A deck must not contain more than a predetermined number of cards of the same suit.

7. A method for setting a minimum amount of cards per suit, value and for a deck as whole.

8. A method for setting a minimum amount of cards per suit, value and for a deck as a whole.

9. A method for specifying individual cards that cannot be added or removed from a constructed deck.

10. A method for setting a maximum deck strength value.

11. A method for preventing further additions of certain cards if the strength value of a deck under construction would exceed a predetermined maximum should a card be added to the deck. 12. A method for storing and comparing the arrangement and deck strength value of constructed decks.

A selected embodiment of the invention will now be explained with reference to the drawings. It will be apparent to those skilled in the art from this disclosure that the following description of the embodiment of the invention is provided for illustration only and not for the purpose of limiting the invention as defined by the appended claims and their equivalents.

FIG. 1 is a schematic representation of the system 10, according to an embodiment of the invention. In the illustrated embodiment, the system 10 includes a server system 12 that is coupled to one or more user computing devices 14 to allow a plurality of players to simultaneously participate in a game. Each user computing device 14 is configured to transmit and receive data to and/or from the server system 12 to display a game 16 and graphical interfaces 18 (shown in FIGS. 5 and 6) to enable a user to participate in "player vs. player" poker-type games with the user computing device 14. In the illustrated embodiment, the server system 12 is coupled to each user computing device 14 via a communications link 20 that enables each user computing device 14 to access server system 12 over a network 22 such as, for example, the Internet 24, a cellular telecommunications network 26, a wireless network and/or any suitable telecommunication network that enables the user computing devices 14 to access the server system 12. For example, in one embodiment, the user computing device 14 includes a mobile computing device 28, e.g. a smartphone that communicates with the server system 12 via the cellular telecommunications network 26 and/or the Internet 24. In another embodiment, the user computing device 14 may include a personal computer, laptop, cell phone, tablet computer, smartphone/tablet computer hybrid, personal/home video game device, personal data assistant, and/or any suitable computing device that enables a user to connect to the server system 12 and display the graphical interfaces 18.

In the illustrated embodiment, each user computing device 14 includes a controller 30 that is coupled to a display device 32 and a user input device 34. The controller 30 receives and transmits information to and from the server system 12 and displays the game 16 and the graphical interfaces 18 (shown in FIGS. 5 and 6) on the display device 32 to enable the user to interact with the server system 12 to play the games in accordance with the embodiments described herein. The display device 32 includes, without limitation, a flat panel display, such as a cathode ray tube display (CRT), a liquid crystal display (LCD), a light-emitting diode display (LED), active-matrix organic light-emitting diode (AMOLED), a plasma display, and/or any suitable visual output device capable of displaying graphical data and/or text to a user. Moreover, the user input device 34 includes, without limitation, a keyboard, a keypad, a touch-sensitive screen, a scroll wheel, a pointing device, a barcode reader, a magnetic card reader, a radio frequency identification (RFID) card reader, an audio input device employing speech-recognition software, and/or any suitable device that enables a user to input data into the controller 30 and/or to retrieve data from the controller 30. Alternatively, a single component, such as a touch screen, a capacitive touch screen, and/or a touchless screen, may function as both the display device 32 and as the user input device 34.

In the illustrated embodiment, the server system 12 includes a gaming controller 36, a communications server 38, a player account server 40, a database server 42, and a database 44 that are connected through a network 46 such as, for example, a local area network (LAN), a wide area network (WAN), dial-in-connections, cable modems, wireless modems, and/or special high-speed Integrated Services Digital Network (ISDN) lines. Moreover, at least one administrator workstation 48 is also connected to the network 46 to enable communication with the server system 12.

The communications server 38 communicates with the user computing devices 14 and the administrator workstation 48 to facilitate transmitting data over the network 22 via the Internet 24 and/or the cellular network 26, respectively.

The database server 42 is connected to the database 44 to facilitate transmitting data to and from the database 44. The database 44 contains information on a variety of matters, such as, for example, account information related to a user, user profile information, a game type, a number of game symbols associated with a game, a number of game outcomes, a payout value associated with each game outcome, wagers, wager amounts, number of playing cards used in a game, type of playing cards used in a game, listing of player decks, number and type of cards included in each player deck, number and type of playing cards included in a board deck, number of board decks used in a game, and/or image data for producing game images and/or screens on the user computing device 14 and temporarily stores variables, parameters, and the like that are used by the gaming controller 36. In one embodiment, the database 44 includes a centralized database that is stored on the server system 12 and is accessed directly via the user computing devices 14. In an alternative embodiment, the database 44 is stored remotely from the server system 12 and may be non-centralized.

The gaming controller 36 includes a processor 50 and a memory device 52 that is coupled to the processor 50. The memory device 52 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the processor 50 to store, retrieve, and/or execute instructions and/or data.

The processor 50 executes various programs, and thereby controls other components of the server system 12 and the user computing device 14 according to user instructions and data received from the user computing devices 14. The processor 50 in particular displays the graphical interfaces 18 (shown in FIGS. 5 and 6) and executes a game program, and thereby enables the system 10 to generate games and allow the users to play the games in response to user instructions received via the user computing devices 14 in accordance with the embodiments described herein. The memory device 52 stores programs and information used by the processor 50. Moreover, the memory device 52 stores and retrieves information in the database 44 including, but not limited to, image data for producing images and/or screens on the display device 32, and temporarily stores variables, parameters, and the like that are used by the processor 50. In addition, the memory device 52 may store a player deck list 54 that includes a plurality of player decks that may be available to one or more players for use in playing the poker-type game. The gaming controller 36 enables players on one or more user computing devices 14 to simultaneously play the same game.

In the illustrated embodiment, the player account server 40 stores information associated with a plurality of user profile accounts and a plurality of corresponding unique user identifiers in a user profile program 56 in the database 44. In the illustrated embodiment, the player account server 40 uses the unique user identifier to identify the user profile account associated with the unique user identifier and provide the user access to the server system 12 to initiate a gaming session via a user computing device 14. In one embodiment, the unique user identifier may include a combination of a username and password. Alternatively, in another embodiment, the unique user identifier may include a personal identification number, or a random identification number assigned to a corresponding user account. For example, in one embodiment, the unique user identifier may include a mobile device identifier, such as, for example, a cellular phone number and/or wireless internet address for identifying a user computing device 14 associated with a user account.

In one embodiment, each user profile account may include personal identification information such as, for example, a user name, address, personal identification number, date of birth, email address, mobile phone number, IP address, URL, and/or any suitable information that enables the player account server 40 to identify a user. In addition, the user profile account may include a player account including player tracking information such as, for example, a type of game previously played by the player, a frequency in which the player plays a game, a number of wagers made during a round of a game, the average number of games played over a predefined period of time, the average credit wager the player makes per play of a game, a total amount wagered by the player over a predefined period of time, and/or any other suitable player tracking information.

In the illustrated embodiment, each user profile account also includes financial account information associated with each user. The financial account information may include, but is not limited to, an amount of betting credits available for use in playing games, available monetary funds for use in purchasing betting credits, an available betting credit account balance, and/or any suitable financial information that enables the system 10 to function as described herein.

In the illustrated embodiment, the workstation 48 includes a display and user input device to enable an administrative user to access the server system 12 to transmit data indicative of the game and/or awards to the database server 42. This enables an administrative user to periodically update the game list, player decks, board decks, game types, wager types, available awards, user profile accounts, and/or any suitable data and information that enables the system 10 to function as described herein.

Figure 2:
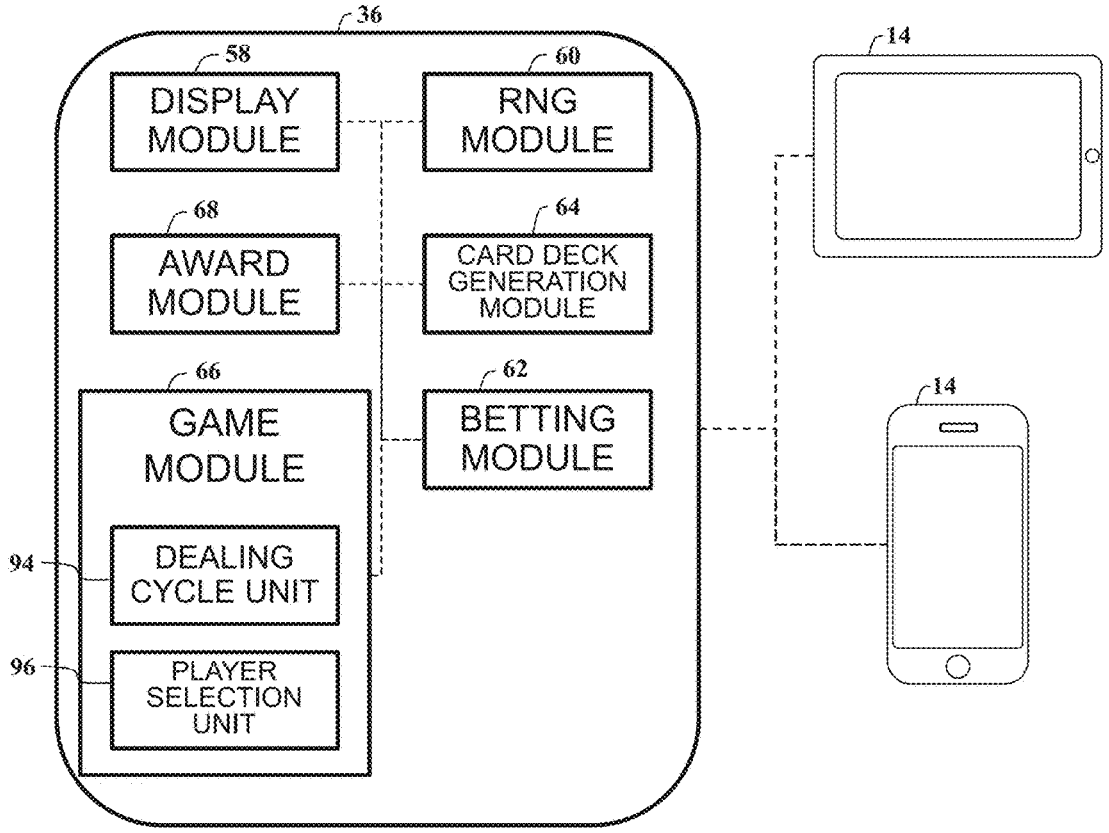
FIG. 2 is schematic view of a gaming controller that may be used with the system shown in FIG. 1.

FIG. 2 is schematic view of the gaming controller 36. In the illustrated embodiment, the gaming controller 36 includes a display module 58, a random-number generator (RNG) module 60, a betting module 62, a card deck generation module 64, a game module 66, and an award module 68.

The display module 58 controls the display device 32 to display various images on the graphical interface 18 preferably by using computer graphics and image data stored in the database 44. More specifically, the display module 58 controls the images and symbols being displayed in a game such as, for example, a poker-type game 16 (shown in FIGS. 5 and 6) on the display device 32 by using computer graphics and the image data. In the illustrated embodiment, the display module 58 also displays a plurality of user selection areas 70 (shown in FIGS. 5 and 6) within the graphical interface 18 that correspond to specific operations that may be initiated by the user. In one embodiment, the display module 58 is configured to display a game screen 72 (shown in FIG. 5) to display information and images associated with the poker-type game 16 including information associated with each player participating in the poker-type game 16. The information associated with each player may vary as a function of the user profile account and the corresponding user computing device 14. For example, in the illustrated embodiment, the gaming controller 36 enables a plurality of players to player the poker-type game 16. The gaming controller 36 identifies each user computing device 14 being associated with each player and generates and displays a different game screen 72 for each player to selectively display personal player information 74 and general player information 76 (shown in FIG. 5) to each of the players. For example, during play of the poker-type game, the gaming controller 36 may display personal player information associated with a player only on a corresponding user computing device 14. Personal player information may include, but is not limited to, the rank and suit of the each playing cards included in the player hand, the strength of the associated player deck, and/or rank and suit of the playing cards included in the associated player deck. The display module 58 may also display general player information to each player including, but not limited to, bet value, rank and suit of playing cards in a communal hand, number of cards included in each player deck, strength of each player deck, and/or a value of credits available for betting to each player.

The betting module 62 communicates with the player account server 40 to manage the amount of player's betting credits and/or monetary funds available for use in playing the poker-type game 16. In the illustrated embodiment, the betting module 62 allows a player to purchase betting credits that are used to place bets during the poker-type game 16. The betting module 62 receives a user selection indicative of a request from a user computing device 14 to play the poker-type game 16 including an amount of betting credits to be purchased for use in placing bets during the game 16. The betting module 62 sends a verification message to the player account server 40 including a unique user identifier and a monetary amount associated with the requested amount of betting credits. The player account server 40 identifies the user profile account associated with the unique user identifier and determines if sufficient funds are available in the user profile account as a function of the user request. If the player account server 40 determines sufficient funds are available in the user profile account, the player account server 40 sends a verification message to the betting module 62 and withdraws a corresponding amount of funds from the user profile account. If the player account server 40 determines that the user profile account does not include a sufficient amount of funds, the display module 58 may display a message on the user computing device 14 requesting the user to deposit additional funds and/or purchase additional betting credits corresponding to the request. In addition, the display module 58 may also display an amount of betting credits included in the user profile account that are available for use in playing and/or wagering on the games.

In the illustrated embodiment, during game play, the betting module 62 generates and displays a betting account 78 including an amount of betting credits 80 available to the player for use in placing bets. During each round of the game, the betting module 62 may receive a request from the player to place a bet and responsively places the bet and deducts the corresponding bet amount from the betting account 78.

The game module 66 includes a game program for use in playing a game based on user selection input receive from a user computing device 14. The game module 66 receives game information included in the database 44 and performs various functions and calculations to play the game according to a set of predetermined game rules and player input. More specifically, the game module 66 retrieves game elements from the database 44 and causes the display module 58 to display the game 16 on the display device 32. The game module 66 receives signals indicative of a user selection input via the user input device 34 and generates an outcome of the game 16 based on the predetermined game rules and the received user selection input, and displays the game outcome on the display device 32.

The RNG module 60 generates and outputs random numbers to the game module 66 for use in playing the game 16. In addition, the game module 66 may use random numbers generated by the RNG module 60 to determine if a winning condition has occurred in the outcome of the game, and to determine whether or not to provide an award to a player. For example, if the game is a poker-type game 16, the game module 66 uses the RNG module 60 to randomly select one or more playing cards 82 to be included in a player deck 84 and/or a board deck 86, and to randomly select one or more playing cards 82 from the player deck 84 and/or the board deck 86 to form a corresponding player hand 88 and/or a communal hand 90, respectively.

In the illustrated embodiment, the award module 68 determines a total amount of bets received during each round of the game and generates and stores the total bet amount in the database 44. During the game, the game module 66 determines an outcome of the poker-type game 16 and transmits the game outcome to the award module 68 including an identification of one or more players achieving a winning player hand. For example, in one embodiment, the poker-type game 16 may include a plurality of winning poker hands, each having an associated value such as, for example, royal flush, straight flush, four of a kind, full house, flush, straight, three of a kind, two pair, one pair, and high card, ranked in descending order. The game module 66 may determine a winning player hand as a function of the value of each associated player hand and the ranked winning poker hands.

The award module 68 responsively provides an award to each identified player determined as a function of the total bet amount. In one embodiment, the game module 66 may determine a value of the winning player hand and transmit the determined player hand value to the award module 68. The award module 68 may compare the game outcome including the value of the player hand with winning combinations stored in a winning combination table to determine if the player hand value and/or game outcome matches a winning outcome that is associated with a type of award. In general, the term "award" may be a payout, in terms of credits or money. Thus, the award module 68 may award a regular payout in response to the outcome of the poker-type game 16. However, it should be noted that the term award may also refer to other types of awards, including, prizes, e.g., meals, show tickets, etc. . . . , as well as in-game award, such as free games, bonus playing cards, bonus player decks, and/or special game modes.

The card deck generation module 64 generates one or more player decks 84 for use with the poker-type game 16. Each player deck 84 includes a set of randomly-ordered playing cards 82. In addition, the card deck generation module 64 may also generate one or more board decks 86 for use with the poker-type game 16 including a plurality of randomly-ordered playing cards 82. In one embodiment, the playing cards 82 are selected from a set of playing cards that includes playing cards having a plurality of ranks including face cards such as, for example, an Ace, King, Queen, and Jack, and number cards such as, for example, a ten, nine, eight, seven, six, five, four, three, and two ranked in descending order of value, and being associated with a plurality of card suits including spades, diamonds, clubs, and hearts. In addition, the set of playing cards may also include one or more wild cards and/or joker cards, which may have a value equal to any other playing card included in the set of playing cards.

In the illustrated embodiment, the card deck generation module 64 generates and stores a plurality of player decks 84 in the player deck list 54. In one embodiment, at least one of the player decks 84 may include an amount of playing cards 82 that is different from an amount included in another player deck 84. For example, the player deck list 54 may include a first player deck 84 (shown in FIG. 6) having 52 playing cards 82 and a second player deck 84 having 45 playing cards 82. In addition, the first player deck 84 may include a different combination of playing cards than the combination playing cards included in the second player deck 84 such as, for example, an amount of number cards, an amount of face cards, an amount of cards per suit, and/or a number of suits.

In the illustrated embodiment, the card deck generation module 64 also determines a deck strength 92 (shown in FIGS. 5 and 6) being associated with a corresponding player deck 84. In one embodiment, the deck strength 92 is indicative of the probability of achieving a winning hand during the poker-type game 16 and may be represented by a value between the range of 1 and 100 points. Alternatively, any value may be assigned to the determined deck strength to provide an indication to the player of the relative strength of the assigned player deck 84 such as, for example "strong", "moderate", and/or "weak". In the illustrated embodiment, the card deck generation module 64 determines a deck strength 92 as a function of the playing cards 82 being included in the corresponding player deck 84. Moreover, the card deck generation module 64 may also determine a probability of achieving a winning poker hand as a function of the rank and suit of each of the playing cards 82 being included in the player deck 84, and determine a corresponding deck strength 92 as a function of the determined probabilities.

For example, the information associated with each player deck 84 and stored in the player deck list 54 may be illustrated as in the following table including information indicative of a deck strength, the playing cards included in the player deck, and probabilities of achieving winning poker hands. The following table is for illustrative purposes only and does not limit the scope of the present invention.

| Player Deck | | Playing Cards | | Probability of Achieving Card Hand | | | |
|---|---|---|---|---|---|---|---|
| Deck No. | Deck Strength | No. of Cards | No. of Suits | Pocket Pair | Jacks or higher | Straight | Full House |
| Deck 1 | 50 | 52 | 4 | 6% | 2% | 3% | 4% |
| Deck 2 | 80 | 45 | 2 | 8% | 2% | 3% | 4% |
| Deck 3 | 85 | 50 | 2 | 6% | 5% | 4.5% | 6% |

The first column represents the corresponding player deck. The second column represents the associated deck strength that is determined as a function of the playing cards being included in the corresponding player deck and the associated probabilities of achieving a winning poker hand determined as a function of the included playing cards. The third and fourth columns represent the number of playing cards and the number of suits being included in the corresponding player deck, respectively. The fifth, sixth, seventh, and eighth columns represent the calculated probabilities associated with achieving a winning poker hand including a pocket pair, a pair jacks or higher, a straight, and a full house.

In general, the gaming controller 36 conducts the poker-type game 16 including dealing a player hand to each player from an assigned player deck, dealing a communal hand from a board deck, and allowing players to place bets after one or more cards associated with the player hand and/or the communal hand have been dealt, and determining an outcome of the poker-type game 16 based on the player hands, the communal hand, and the placed bets.

In the illustrated embodiment, the gaming controller 36 includes a dealing cycle unit 94 and a player selection unit 96. The player selection unit 96 is configured to assign a player deck 84 to each of the players 98 participating in the poker-type game 16, such that each player 98 is assigned a different player deck 84. The dealing cycle unit 94 is configured to distribute a plurality of playing cards 82 to each player to form a corresponding player hand 88. In addition, the dealing cycle unit 94 may distribute a plurality of playing cards 82 from a board deck 86 to form a communal hand 90.

In the illustrated embodiment, the dealing cycle unit 94 conducts one or more dealing cycles during a round of the poker-type game 16. During the game round, the dealing cycle unit 94 distributes a player hand 88 to each of the plurality of players 98 including one or more playing cards 82 selected from the assigned player deck 84. In one embodiment, the dealing cycle unit 94 may randomly select one or more cards from a corresponding assigned player deck 84 to form the associated player hand 88. In another embodiment, the dealing cycle unit 94 may select the playing cards 82 in sequential order from the assigned player deck 84.

In the illustrated embodiment, the gaming controller 36 conducts one or more rounds of the game, and the dealing cycle unit 94 is configured to conduct one or more dealing cycles during each game round. During each dealing cycle, the dealing cycle unit 94 distributes one playing card to each player hand 88 from the corresponding player deck 84 in a sequential order beginning with a starting player 100, e.g. a designated "dealer", (indicated with the "D" reference label shown in FIG. 5) and moving in a clockwise or counter-clockwise direction. In one embodiment the dealing cycle unit 94 is configured to distribute each of the player hands 88 such that each player hand 88 includes different playing cards 82 having a different rank and/or a different suit. Moreover, during the dealing cycle, for each player, the dealing cycle unit 94 may select a first playing card from a corresponding player deck 84 to be dealt to the associated first player hand 88 and determine if the selected first playing card matches any of the playing cards that have previously been distributed to any of the players during the dealing cycle, e.g. any card currently included in another player hand. If the selected first playing card does not match any previously dealt card in the dealing cycle, the dealing cycle unit 94 distributes the first selected card to the associated player hand 88. If the first playing card matches a previously dealt card, e.g. a card already included in another player hand, the dealing cycle unit 94 responsively selects another playing card from the corresponding player deck 84 to replace the first card and distributes the playing card in the corresponding player hand 88.

The dealing cycle unit 94 may also determine a number of playing cards being included in each player hand 88 as a function of a predefined number of cards, and conducts a number of dealing cycles until each corresponding player hand 88 includes the predefined number of playing cards. The predefined number of cards may be determined as a function of the game rules associated with the poker-type game.

In addition, in one embodiment, during a dealing cycle, the dealing cycle unit 94 may select a first card from the board deck 86 to be include in the communal hand 90, determine if the selected first card matches any of the playing cards 82 included in the distributed player hands 88, and responsively select another playing card from the board deck 86 to replace the selected first card and to be included in the communal hand 90 if the first card matches any distributed player hand card 82.

In one embodiment, the game module 66 may also determine if a playing card 82 included in the communal hand 90 matches a playing card 82 included one or more player hands 88, and responsively replace each matching player hand card 82 with a wild card.

In the illustrated embodiment, during a subsequent game round, the card deck generation module 64 removes each playing card 82 included in a previously dealt player hand 88 during the previous round from each corresponding player deck 84 to form a modified player deck 84. The dealing cycle unit 94 then conducts one or more dealing cycles during the subsequent round with the modified player decks 84. In one embodiment, the game module 66 allows each player to select one or more cards being discarded from the corresponding player hand 88 and to add the discarded cards to the corresponding player deck 84 to form the modified player deck 84. In addition, during each subsequent game round, the board deck 86 may be reshuffled after each dealing cycle. In addition, each player deck 84 may not be reshuffled such that the number of playing cards 82 included in each player deck 84 is reduced for each subsequent round.

In one embodiment, the card deck generation module 64 may determine a modified deck strength associated with the modified player deck 84 and display the modified deck strength to the associated player. For example, in one embodiment, the game module 66 may conduct a first round of the poker-type game 16 and distribute a player hand 88 to each of the players for use during the first round. The game module 66 may conduct a second round by discarding the playing cards included in each of the player hands included in the first round and form the modified player decks 84 including any remaining playing cards for use in the second round. By generating a modified player deck 84 for use in each game round, the probability of achieving a winning poker hand changes during each round of the game, thus increasing the overall volatility of the poker-type game 16.

In the illustrated embodiment, the game module 66 is configured to detect if a triggering condition occurs during each of the dealing cycles and responsively generate a reassembled player deck for use by the player. More specifically, upon detecting a triggering condition occurring in a dealing cycle, the card deck generation module 64 adds each previously played player hand to the modified deck to form a reassembled player deck. The dealing cycle unit 94 then completes the corresponding dealing cycle with the reassembled player decks. Moreover, the card deck generation module 64 may randomly order each playing card in the reassembled player deck such that the reassembled player deck includes an order of playing cards 82 that is different from the order of playing cards 82 included in the initial player deck 84.

In one embodiment, the triggering condition may be defined as a pre-determined card being distributed to at least one player during a corresponding dealing cycle such as, for example, a playing having a predefined rank and/or suit. For example, the game module 66 may detect a wild card being distributed to player during a dealing cycle and responsively form a reassembled deck for each player upon detecting the wild card. In another embodiment, the triggering condition may be defined as each card being included in a modified deck matching each previously distributed card in the corresponding game round. Moreover, the triggering condition may be defined as all playing cards included in a modified player deck being distributed during the corresponding game round such that a player can no longer be dealt the required number of playing cards from the corresponding modified player deck. In one embodiment, the gaming controller 36 may award a player a reassembling award that enables the player to request the game module 66 to generate the reassembled player decks during a dealing cycle.

The player selection unit 96 assigns a player deck 84 to each player that is participating in the poker-type game 16. In one embodiment, the card deck generation module 64 may randomly select a player deck 84 and assign the player deck 84 to a player. In another embodiment, the card deck generation module 64 may allow a player to select a player deck 84 from the player deck list 54. In addition, the card deck generation module 64 may allow a player build a personal player deck by selecting one or more playing cards 82 being included in the personal player deck. Moreover, the card deck generation module 64 may determine a deck strength 92 of the personal player deck based on the player selected playing cards 82, and allow the player to add or remove additional playing cards 82 to the personal player deck to adjust the associated deck strength 92.

In one embodiment, the player selection unit 96 may also assign a player deck 84 to a player based on predefined player deck criteria that is stored in a corresponding user profile account such as, for example, deck color, number of face cards, number of cards per suit, number of suits, deck strength and/or any suitable criteria that may be associated with a player deck. In addition, the player selection unit 96 may retrieve player tracking information associated with a corresponding user profile account and select one or more player decks 84 as a function of the player tracking data. For example, in one embodiment, the player selection unit 96 may select a deck strength of the player deck as a function of a player ranking. In one embodiment, a lower ranked player, e.g. a player having a lower level of playing skill, may be able to select a player deck 84 having a higher deck strength than a player deck 84 selected by a higher rank player, e.g. a player having a higher level of playing skill. In this manner, a lower ranked player may be able to better compete with the higher ranked player during the poker-type game 16.

Figure 3:
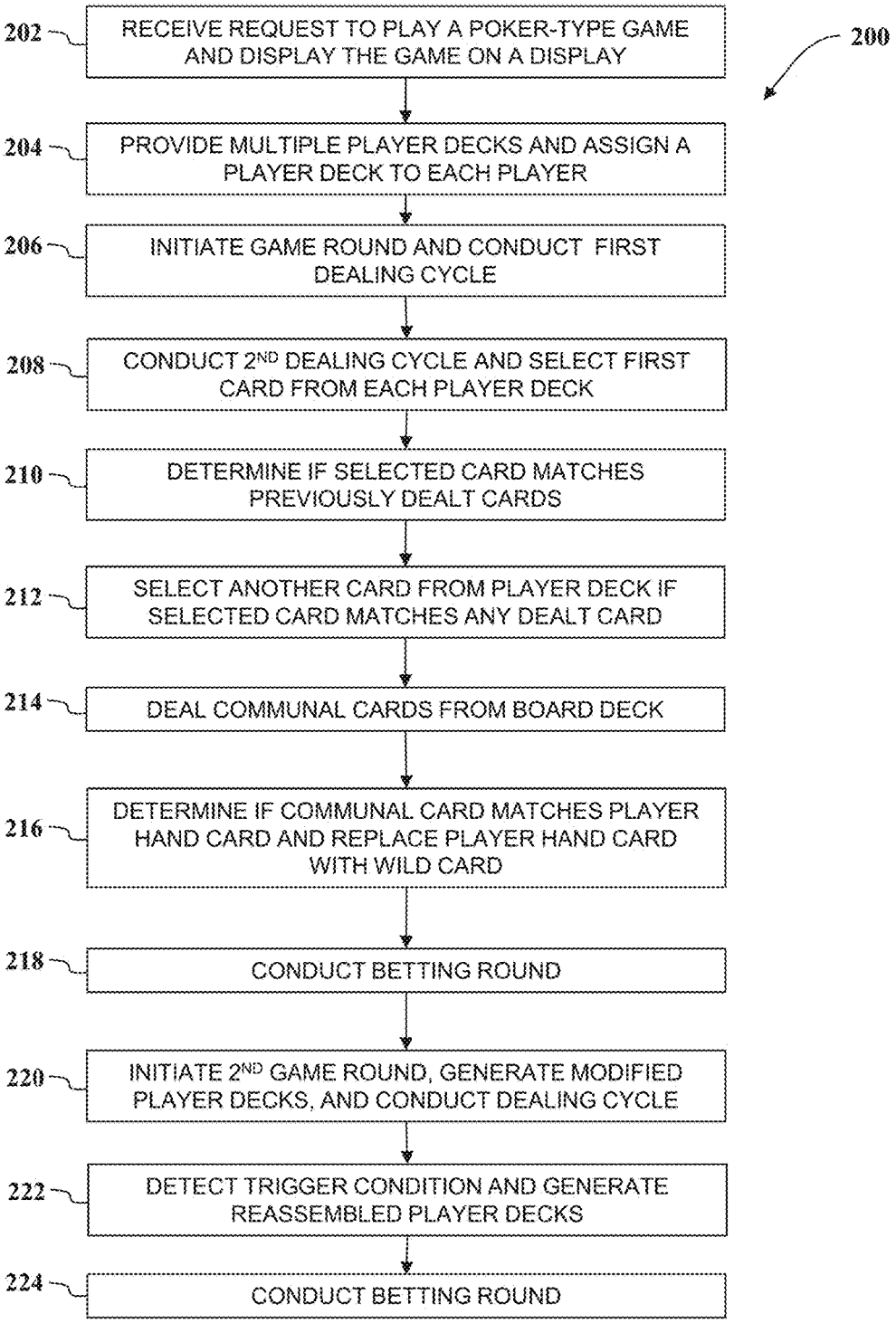
FIG. 3 is a flowchart of a method that may be used with the system shown in FIG. 1 for allowing a player to play a poker-type game, according to an embodiment of the invention.
Figure 4:
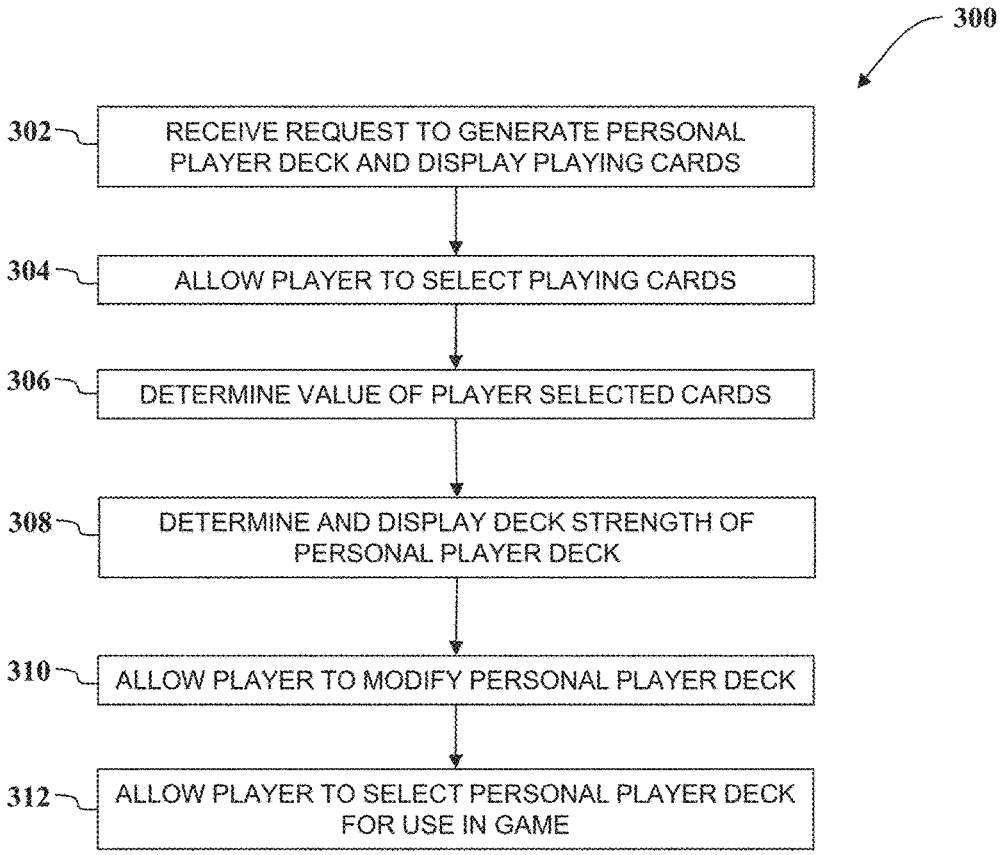
FIG. 4 is a flowchart of a method that may be used with the system shown in FIG. 1 for allowing a player to select a player deck for use in a poker-type game, according to an embodiment of the invention.
Figure 5:
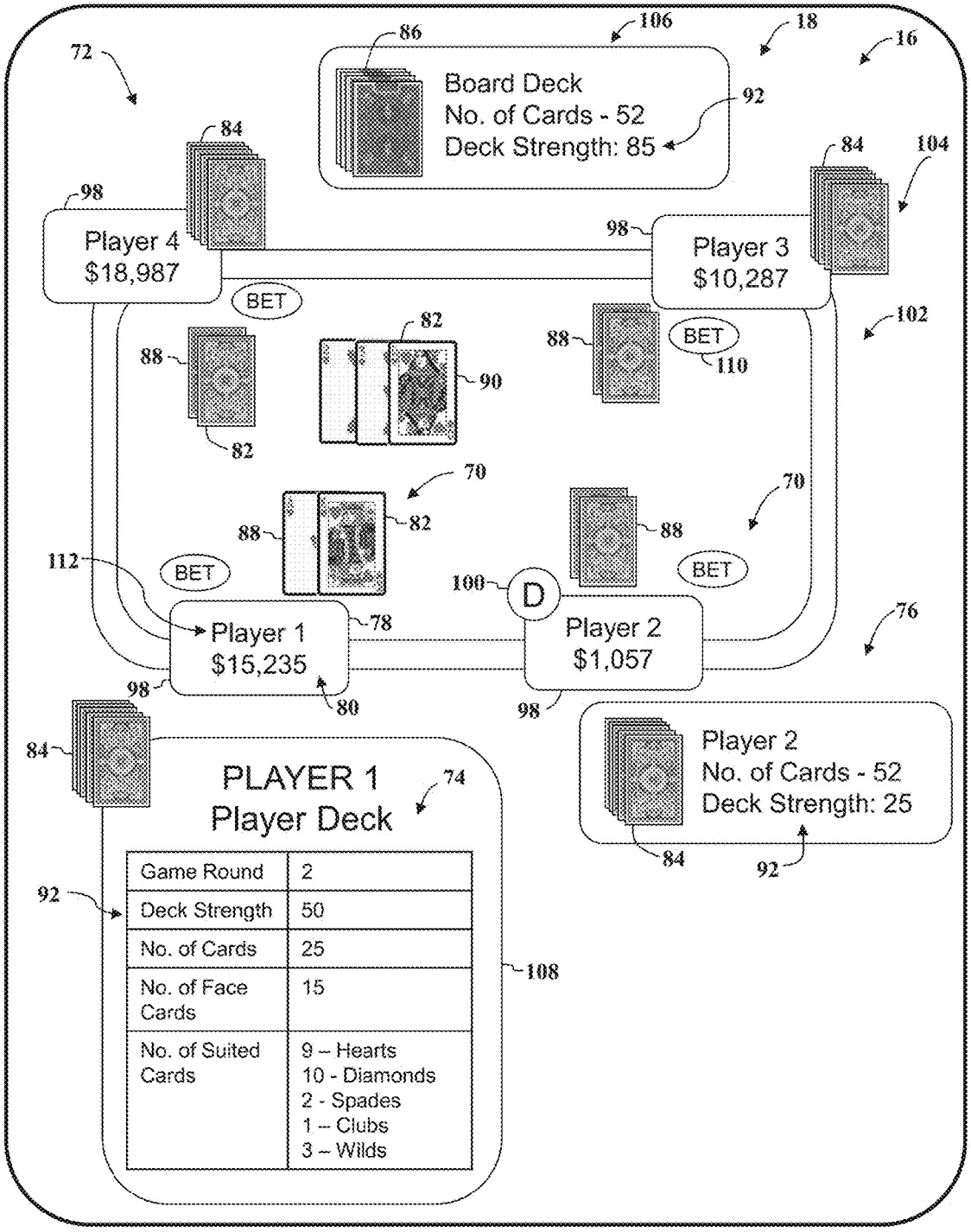
FIGS. 5 and 6 are exemplary entertaining graphical displays of a poker-type game that may be used with the method shown in FIGS. 3 and 4, according to an embodiment of the present invention.
Figure 6:
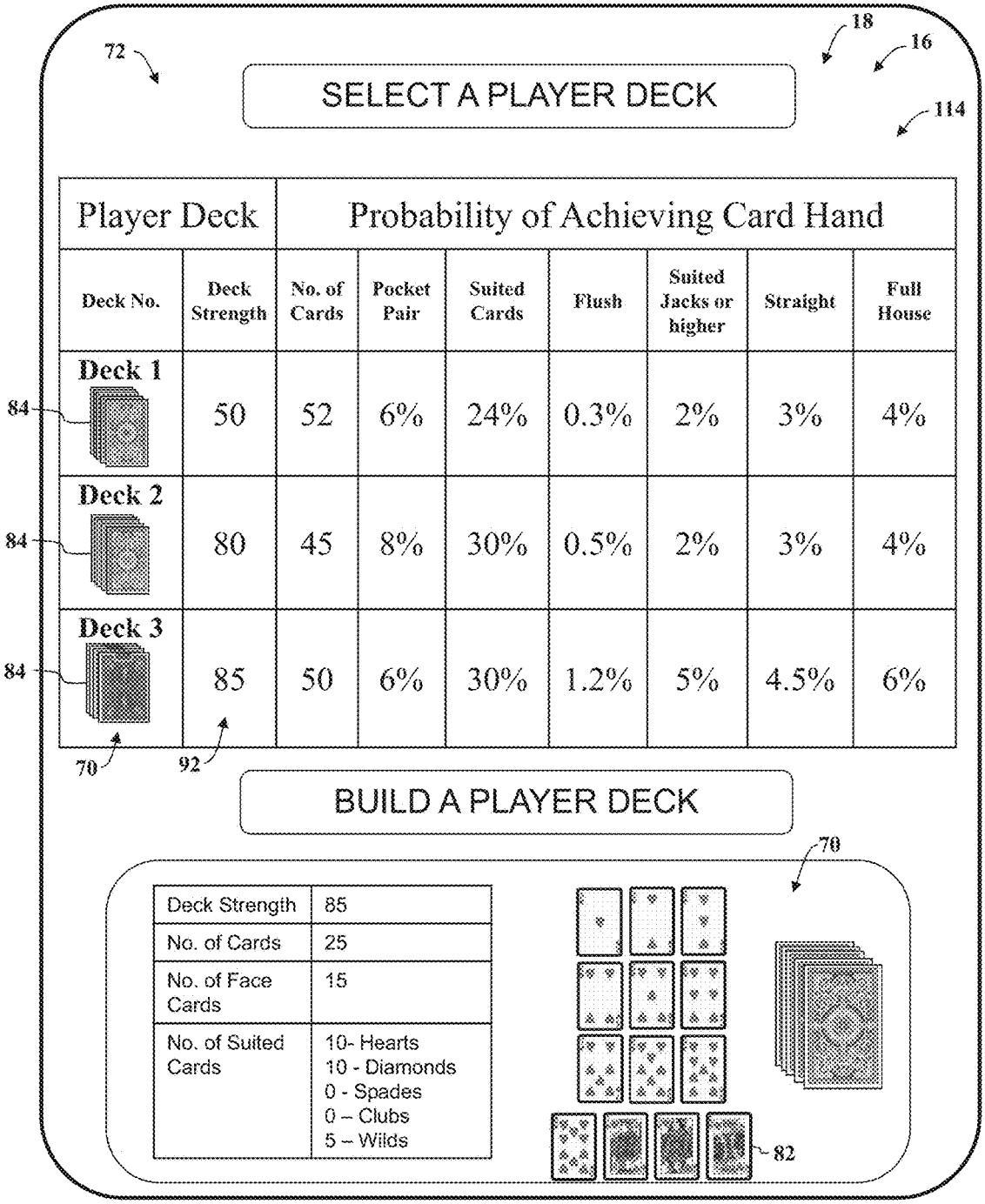

FIG. 3 is a flowchart of a method 200 that may be used with the system 10 for allowing a player to play the poker-type game 16. FIG. 4 is a flowchart of a method 300 that may be used with the system 10 for allowing a player to select a player deck 84 for use with the poker-type game 16. Each method step may be performed independently of, or in combination with, other method steps. Portions of the methods 200 and 300 may be performed by any one of, or any combination of, the components of the system 10. FIGS. 5 and 6 are exemplary entertaining graphical displays of the poker-type game 16 that may be played with the system 10. In the illustrated embodiment, entertaining graphical displays for amusement purposes are presented by the user computing device 14 via the display device 32 (shown in FIG. 1) and may receive input (e.g., selections and/or entries) via the user input device 34 (shown in FIG. 1). For example, in one embodiment, a selection may be received via the user input device 34 of the user computing device 14 and may be transmitted by the user computing device 14 to the server system 12 via the network 22.

In the illustrated embodiment, in the method step 202, the gaming controller 36 receives a request from a player to play the poker-type game 16 from a user computing device 14 and displays the game 16 on the display device 32 for play by the player. In one embodiment, the player may submit the request by accessing a website via the communications server 38. In another embodiment, the player may access a mobile website via the cellular network 26. In addition, in one embodiment, the method step 202 may include receiving, by the gaming controller 36, a unique user identifier to validate the request to display the poker-type game 16. More specifically, the display module 58 may display a login screen (not shown) on the user computing device 14 to request the unique user identifier such as, for example, requesting a username and/or password. The gaming controller 36 may receive the unique user identifier and transmit a validation request including the user credentials to the player account server 40. The player account server 40 may compare the received unique user identifier with the collection of unique user identifier contained in the user profile program to validate the unique user identifier and responsively send a validation message to the gaming controller 36 if the received unique user identifier is included in the user profile program. Upon receiving the validation message from the player account server 40 the gaming controller 36 may display the game 16. In addition, in one embodiment, if the received user identifier is not included in the user profile program 56, the gaming controller 36 may prompt the user to establish a user account and/or display the game 16 without requiring the user to establish a user account and/or verify a user account. In addition, in one embodiment, method step 202 may also include receiving a wager from the player and/or receiving a request to purchase a play of the game with game credits from the corresponding user profile account.

In method step 202, the gaming controller 36 may also displays a game screen 72 (shown in FIG. 5) including the game 16 in response to the request received from the player via the user computing device 14. In the illustrated embodiment, the gaming controller 36 displays the poker-type game 16. However, it should be noted that the gaming controller 36 may display any type of game upon which a player could make a wager and/or purchase a game play including, but not limited to a slot game, a blackjack game, a video poker game, or any type of game that enables the system 10 to function as described herein.

In the illustrated embodiment, during method step 202, the game module 66 displays the poker-type game 16 game including a poker table area 102, a plurality of player stations 104, a communal area 106, and a player account area 108. The poker table area 102 may include a plurality of betting areas 110 associated with each player and may display a corresponding betting amount being placed by the associated player. Each player station 104 may display general player information 76 associated with each participating player including a player identification 112, a betting account 78, a player deck 84, a deck strength, a number of cards in the associated player deck, a dealer indication, i.e. starting player during a dealing cycle, and/or a player hand 88. In the illustrated embodiment, the suit and rank of each player hand is not displayed with the general player information 76 until a "showdown" request is received from a player at the conclusion of a betting round.

The communal area 106 may display information associated with the communal hand 90 and the board deck 86 including, but not limited to, suit and rank of cards included in the communal hand 90, number of cards included in the board deck 86, and/or deck strength of the board deck 86. The player account area 108 may display personal player information 74 associated with the corresponding player 98 including, but not limited to, the rank and suit of the each playing cards included in the player hand 88, the deck strength of the associated player deck 84, and/or rank and suit of the playing cards 82 included in the associated player deck 84.

In method step 204, gaming controller 36 provides a plurality of player decks 84 and assigns a player deck 84 to each of the participating players 98 such that each player 98 is assigned an individual player deck 84 for use during the game. Each of the player decks 84 includes a set of randomly-ordered playing cards 82. In one embodiment, the gaming controller 36 randomly assigns each player a player deck 84 from the player deck list 54 included in the database 44. In another embodiment, the gaming controller 36 may allow the player to select and/or purchase a player deck 84 from the player deck list 54. In addition, the gaming controller 36 may determine a value of each playing card 82 being included in each of the player decks 84, determine a deck strength 92 associated with each of the player decks 84 as a function of the determined value of each included playing card 82, and display the deck strength 92 associated with each assigned player deck 84 to each corresponding player.

In method step 206, the gaming controller 36 initiates a first round of the game 16 including distributing a first player hand 88 to each of the plurality of players 98. Each of the first player hands 88 includes one or more cards being distributed from a corresponding player deck 84 assigned to the player 98. In one embodiment, the gaming controller 36 may distribute each of the first player hands such that each first player hand includes different playing cards. In method step 206, the gaming controller 36 may also conduct a first dealing cycle including distributing one playing card to each player hand 88 from the corresponding player deck 84 in a sequential order beginning with the starting player 100.

In method step 208, the gaming controller 36 conducts a second dealing cycle including distributing an additional playing card to each player hand 88 from the corresponding player deck 84 in a sequential order beginning with a starting player 100. In method steps 208-212, during the dealing cycle, for each player, the gaming controller 36 selects a first card from a corresponding player deck 84 to be include in the associated player hand 88, determines if the selected first card matches any of the cards previously distributed during the corresponding dealing cycle, and responsively selects another card from the corresponding player deck 84 to replace the first card and to be included in the corresponding first player hand 88. Moreover, if the selected first card does not match any previously dealt card in the cycle, the gaming controller 36 distributes the selected first card to the corresponding first player hand 88. In one embodiment, the gaming controller 36 may conduct additional dealing cycles until each corresponding player hand includes a predefined number of playing cards.

In method step 214, the gaming controller 36 conducts a communal deal cycle and distributes a communal hand 90 including one or more cards being distributed from the board deck 86. During the communal deal cycle, the gaming controller 36 selects a card from the board deck 86 to be include in the communal hand 90, determines if the selected card matches each of the playing cards included in the distributed player hands 88, and responsively selects another card from the board deck 86 to be included in the communal hand 90 if the first selected card matches a distributed player hand card.

In method step 216, the gaming controller 36 determines if a playing card included in the communal hand 90 matches any playing card included in any distributed player hand 88, and replaces each matching player card 82 with a wild card, and determines a value of a corresponding player hand 88 as a function of the wild card and the remaining playing cards 82.

In method step 218, the gaming controller 36 conducts a betting round and allows each player 98 to place a bet on the outcome of the game. Upon conclusion of the betting round, the gaming controller 36 conducts a "showdown" operation to display the rank and suit of each card included in each player hand 88 associated with each remaining player 98, determines an outcome of the first round as a function of each of the remaining first player hands 88, and providing an award to at least one of the players as a function of the received wagers and the outcome.

In method step 220, the gaming controller 36 removes each first player hand 88 from each corresponding player deck 84 to form a modified player deck that is assigned to each player 98. In one embodiment, the gaming controller 36 may remove each corresponding first player hand 88 from each corresponding player deck 84 to form the modified player deck, determine a modified deck strength associated with each modified player deck, and display the modified deck strength associated with each modified player deck to each corresponding player 98. In method step 220, the gaming controller 36 initiates a second round of the game and distributes a second player hand to each of the players including cards from the corresponding modified player deck being assigned to each player. The gaming controller 36 conducts a dealing cycle with each modified deck by distributing one card to each player hand from the corresponding modified player deck in a sequential order.

In method step 222, the gaming module detects if a triggering condition occurs in the dealing cycle, and responsively generates a reassembled deck associated with each player for use during the remainder of the dealing cycle. In one embodiment, the game module 66 may add each corresponding first player hand to each corresponding modified deck to form the reassembled player deck and complete the corresponding dealing cycle with the reassembled player decks. In another embodiment, the game module 66 may allow one or more players to select one or more playing cards from the discarded player hand to be included in the reassembled player deck. In addition, the game module 66 may randomly re-order the playing cards included in the reassembled player deck.

In method step 224, the gaming controller 36 conducts a betting round and allows each player to place a bet on the outcome of the second round of the game.

In method steps 302-304, the gaming controller 36 display a plurality of playing cards 82 for use in forming a player deck in a deck selection screen 114, and allows a player to select one or more of the playing cards 82 to be included in a personal player deck.

In method steps 306-308, the gaming controller 36 determines a value of each selected playing card being included in the personal player deck, determines a deck strength associated with the personal player deck as a function of the value associated with each selected playing card, and displays the deck strength of the personal player deck to the corresponding player.

In method step 310, the gaming controller 36 may allow the player to modify the player deck by selecting additional playing cards and/or removing playing cards from the personal player deck and may recalculate the associated deck strength.

In method step 312, the gaming controller 36 may allow the player to select and/or purchase the personal player deck for use in the poker-type game 16 and associate and store the personal player deck in the corresponding user profile account.

Figure 7:
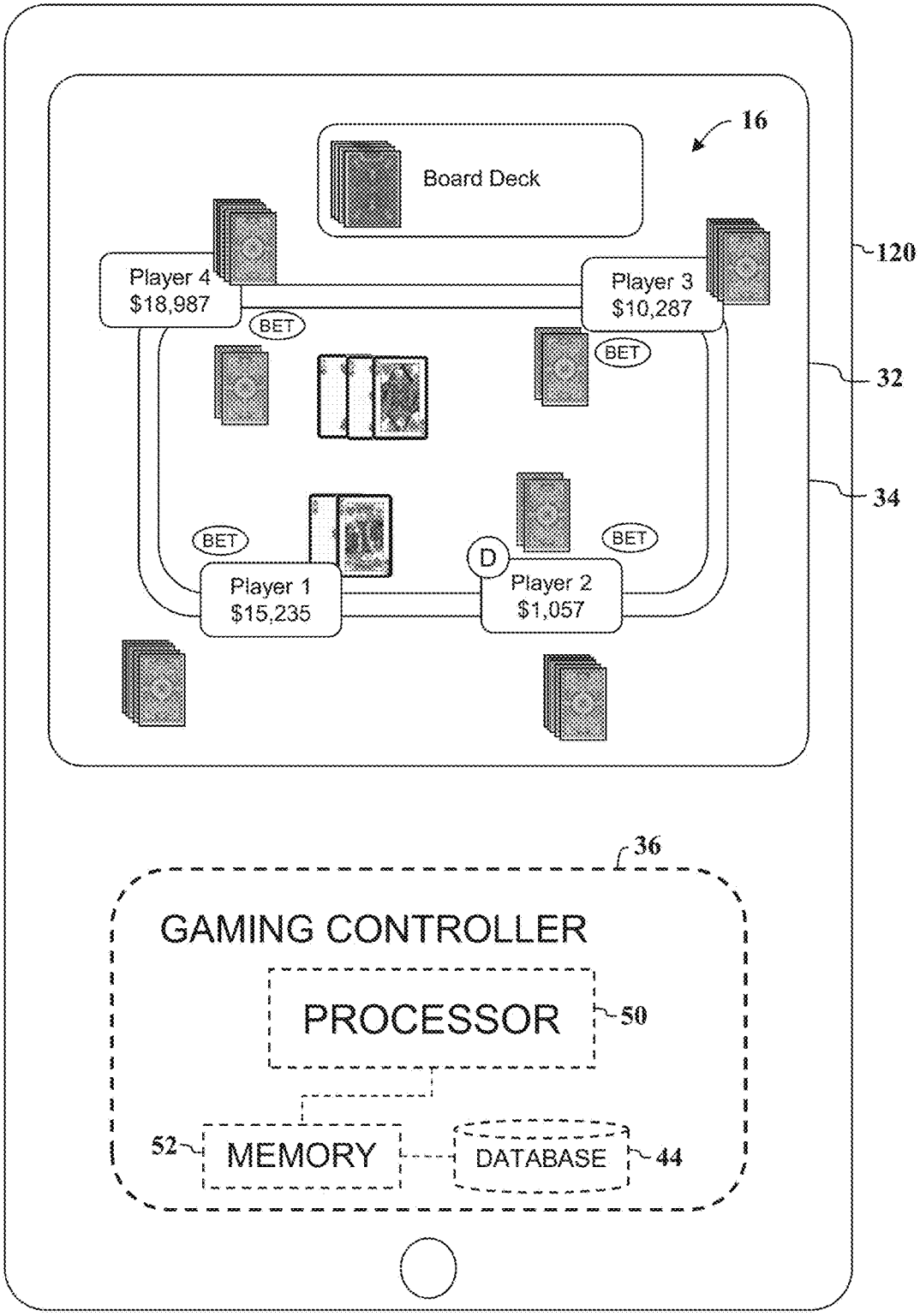
FIG. 7 is a schematic representation of a gaming device for allowing a player to play the poker-type game shown in FIGS. 5 and 6, according to an embodiment of the invention.

FIG. 7 is a schematic view of a gaming device 120 for allowing a player to play the poker-type game 16, according to an embodiment of the invention. The gaming device 120 may be a smartphone, a personal computer, laptop, cell phone, tablet computer, smartphone/tablet computer hybrid, personal data assistant, and/or any suitable computing device that displays the graphical interfaces 18 and enables the user to play the poker-type game 16. In the illustrated embodiment, the gaming device 120 includes the display device 32, the user input device 34, and the gaming controller 36 coupled to the display device 32 and the user input device 34.

The gaming controller 36 includes the processor 50, the memory device 52, and the database 44. The memory device 52 stores programs and information used by the processor 50 including, but not limited to, image data for producing images and/or screens on the display device 32, game indicia, playing cards, card weights, player decks, board decks, and/or winning poker hand tables which represent relationships between combinations of playing cards types of awards associated with the poker-type game 16.

The processor 50 includes a computer readable medium, such as, without limitation, random access memory (RAM), read-only memory (ROM), erasable programmable read-only memory (EPROM), flash memory, a hard disk drive, a solid state drive, a diskette, a flash drive, a compact disc, a digital video disc, and/or any suitable device that enables the gaming controller 36 to store, retrieve, and/or execute instructions and/or data. The gaming controller 36 in particular executes a game program to implement the methods 200 and 300 and thereby conducts a game in accordance with the embodiments described herein.

Figure 8:
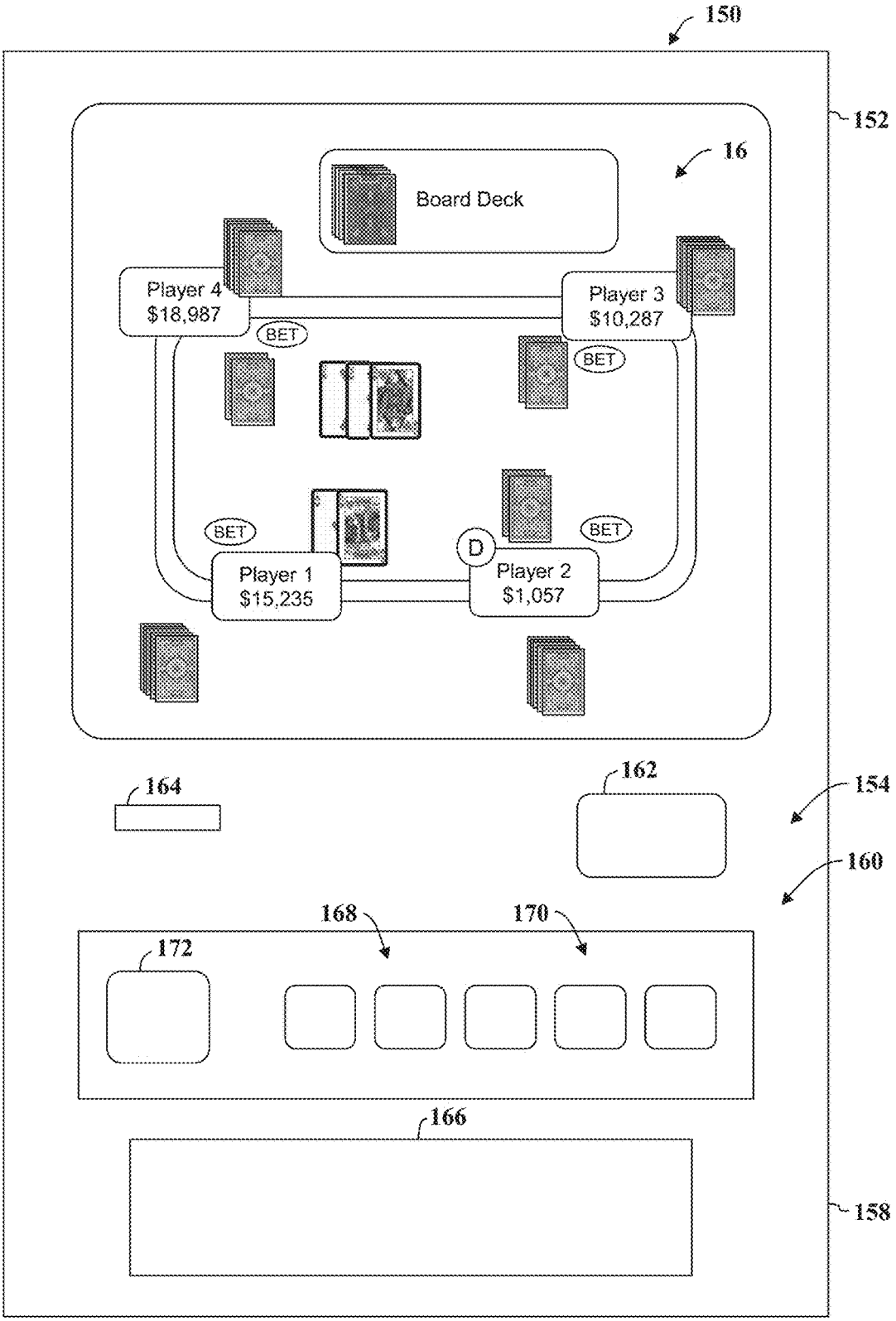
FIG. 8 is a schematic representation of a gaming machine for allowing a player to play the poker-type game shown in FIGS. 5 and 6, according to an embodiment of the invention.
Figure 9:
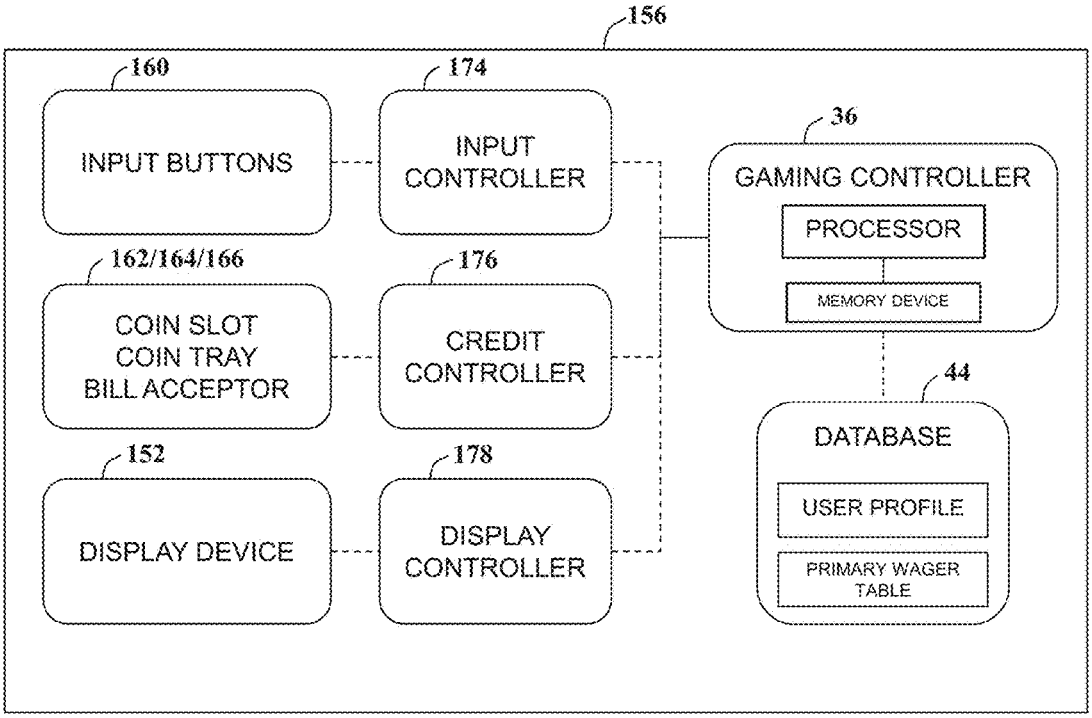
FIG. 9 is another schematic view of the gaming machine shown in FIG. 8.

FIG. 8 is a schematic representation of a gaming machine 150 that may be used to allow a player to play the poker-type game 16, according to an embodiment of the present invention. FIG. 9 is another schematic view of the gaming machine 150. A preferred embodiment of the present invention is a video gaming machine preferably installed in a casino. In the illustrated embodiment, the gaming machine 150 includes a display device 152 such as, for example display device 32 for displaying a plurality of games, a user input device 154 to enable a player to interface with the gaming machine 150, and a system controller 156 that is operatively coupled to the display device 152 and the user input device 154 to enable a player to play games displayed on the display device 152. The gaming machine 150 may also include a cabinet assembly 158 that is configured to support the display device 152, the user input device 154, and/or the system controller 156 from a supporting surface.

The display device 152 and the user input device 154 are coupled to the cabinet assembly 158 and are accessible by the player. In one embodiment, the system controller 156 is positioned within the cabinet assembly 158. Alternatively, the system controller 156 may be separated from the cabinet assembly 158, and connected to components of the gaming machine 150 through a network such as, for example, a local area network (LAN), a wide area network (WAN), dial-in-connections, cable modems, wireless modems, and/or special high-speed Integrated Services Digital Network (ISDN) lines.

In the illustrated embodiment, the display device 152 displays the game screen 72 (shown in FIGS. 5 and 6) including indicia and/or symbols for use in a game, e.g., symbols for a bingo game, cards used by a card game, roulette wheel and symbols used in a roulette game, and/or reels used in a reel game.

The user input device 154 includes a plurality of input buttons 160, a coin slot 162, a bill acceptor 164, and a coin tray 166 for dispensing coins to the player. In one embodiment, the input buttons 160 may include a plurality of BET switches 168 for inputting a wager on a game and selecting a number of rounds to be played during a gaming session, a plurality of selection switches 170 for allowing a player to select a plurality of game symbols, a PAYOUT switch 172 for ending a gaming session and dispensing accumulated game credits to the player. In addition, the user input device 154 may include, for example, a keyboard, a pointing device, a mouse, a stylus, a touch sensitive panel (e.g., a touch pad or a touch screen), a gyroscope, an accelerometer, a position detector, an audio input device, and/or any suitable input device that enables the player to interact with the gaming machine 150.

The coin slot 162 includes an opening that is configured to receive coins and/or tokens deposited by the player into the gaming machine 150. The gaming machine 150 converts a value of the coins and/or tokens to a corresponding amount of game credits that are used by the player to wager on games played on the gaming machine 150. The bill acceptor 164 includes an input and output device that is configured to accept a bill, a ticket, and/or a cash card into the gaming machine 150 to enable an amount of game credits associated with a monetary value of the bills, ticket, and/or cash card to be credited to the gaming machine 150.

Referring to FIG. 9, in the illustrated embodiment, the system controller 156 includes the gaming controller 36, the database 44, an input controller 174, a credit controller 176, and a display controller 178. The gaming controller 36 communicates to the database 44, the input controller 174, the credit controller 176, and the display controller 178, and executes various programs, and thereby controls other components of the gaming machine 150 according to player instructions and data accepted by the user input device 154. The gaming controller 36 in particular executes a game program to implement the methods 200 and 300 and thereby conducts a game in accordance with the embodiments described herein. In one embodiment, the gaming controller 36 utilizes RAM to temporarily store programs and data necessary for the progress of the game, and EPROM to store, in advance, programs and data for controlling basic operation of the gaming machine 150, such as the booting operation thereof.

The credit controller 176 manages the amount of player's credits, which is equivalent to the amount of coins and bills counted and validated by the bill acceptor 164. The credit controller 176 converts a player's credits to coins, bills, or other monetary data by using the coin tray 166 and/or for use in dispensing a credit voucher via the bill acceptor 164.

The input controller 174 is coupled to the user input device 154 to monitor player selections received through the input buttons 160, and accept various instructions and data that a player enters through the input buttons 160.

The display controller 178 controls the display device 152 to display various images on screens preferably by using computer graphics and image data stored in the database 44. More specifically, the display module 58 controls the game symbols displayed in the game such as, for example, a poker-type game 16 displayed on the display device 152 by using computer graphics and the image data.

The above-described systems and methods overcome at least some disadvantages of known systems by allowing a plurality of players to play a poker-type game. Each player is assigned a individual player deck and is dealt a player hand from the associated player deck. The system may deal each player hand such that each player hand includes different cards by determining if a card being dealt to a corresponding player matches a previously dealt card and requiring the player to select another card from the corresponding player deck to form the player hand. Moreover, the system may also modify each of the player decks after each round by removing the previously played player hands from each of the assigned player decks. By modifying each player deck to remove previously played hands, the system adjust the probability of achieving winning poker hands associate with each player deck for each round of the poker-type game. Thus, the player's expectation of achieving a winning outcome is increased and the amount of time that the game is played by the patrons of a gaming establishment is thereby increased, thus increasing an overall profitability of the gaming establishment.

The invention is also directed to a system for providing wagering games, such as those described herein which includes the following components, among others things: a data input device, a display device, and a data processing device for providing the methods and embodiments of the invention as described herein.

The aforementioned systems may be an electronic gaming machine or electronic platform including multiple data input devices providing player positions. The system may also include a transceiving device for providing the wagering game to players via an online system or the Internet. The data input device may also be included in a touch-enabled display device or consist of a remote terminal in communication with the processing device.

It should be understood that the methods and steps recited herein may be partially or wholly carried out in a variety of ways, such as by a dealer or player physically using game elements, via an electronic gaming machine (EGM) in a gaming establishment, through a computer or portable device, such as a mobile phone, capable of communicating via the Internet, global telecommunication network or world wide web. It should further be understood that the methods and systems of the invention are described herein in connection with standard gaming implements for illustrative purposes only, as the methods and systems of the invention may be used with non-standard gaming implements or any other items with varying distinguishable values or symbols.

Those skilled in the art will readily appreciate that the methods described herein may be incorporated in a system in accordance with the invention using virtual representations of gaming implements. The methods and systems of the invention may include various computer and network related software and hardware, such as programs, operating systems, memory storage devices, data input/output devices, data processors, servers with links to data communication systems, wireless or otherwise, and data transceiving terminals, and may be a standalone device or incorporated in another platform, such as a mobile device. The methods and systems of the invention may be provided on electronic platforms with multiple player positions. In addition, the methods and systems of the invention may be provided at least in part on a personal computing device, such as home computer, laptop or mobile computing device through an online communication connection or connection with the Internet. Those skilled in the art will further appreciate that the precise types of software and hardware used are not vital to the full implementation of the methods of the invention so long as players and operators thereof are provided with access thereto or the opportunity to play and wager on the games as described herein.

While exemplary methods and applications of the methods of the invention have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the present invention in any way. Accordingly, the invention embraces alternatives, modifications and variations which fall within the spirit and scope of the invention as set forth in the embodiments herein and equivalents thereto.

A controller, computing device, or computer, such as described herein, includes at least one or more processors or processing units and a system memory. The controller typically also includes at least some form of computer readable media. By way of example and not limitation, computer readable media may include computer storage media and communication media. Computer storage media may include volatile and nonvolatile, removable and non-removable media implemented in any method or technology that enables storage of information, such as computer readable instructions, data structures, program modules, or other data. Communication media typically embody computer readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database. Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the invention can be obtained from a study of the drawings, the disclosure, and the appended claims. The invention may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the systems and methods described herein may be a standalone system or incorporated in an existing gaming system. The system of the invention may include various computer and network related software and hardware, such as programs, operating systems, memory storage devices, data input/output devices, data processors, servers with links to data communication systems, wireless or otherwise, and data transceiving terminals. It should also be understood that any method steps discussed herein, such as for example, steps involving the receiving or displaying of data, may further include or involve the transmission, receipt and processing of data through conventional hardware and/or software technology to effectuate the steps as described herein. Those skilled in the art will further appreciate that the precise types of software and hardware used are not vital to the full implementation of the methods of the invention so long as players and operators thereof are provided with useful access thereto, either through a mobile device, gaming platform, or other computing platform via a local network or global telecommunication network.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A system for providing a poker-type card game to a plurality of players, comprising:

a plurality of user computing devices associated with the plurality of players, each of the user computing devices configured to receive input from a corresponding player and including a display device for displaying the game on a game screen, at least one of the user computing devices including a gaming machine including an acceptor device configured to accept physical media associated with a monetary value to establish a credit balance associated with a player;

a database for storing a plurality of player decks; and a server computer including a controller coupled to each user computing device and the database, the controller including a memory device and a processor coupled to the memory device, the memory device including a game program including computer-executable instructions, when executed by processor, the computer-executable instructions cause the processor to:

receive a signal from the gaming machine indicating a wager or fee initiated by the player, adjust the credit balance by an amount of the wager or fee, and initiate the game including displaying the game screen on each of the plurality of user computing devices;

access the database and retrieve the plurality of player decks, each of the plurality of player decks including a set of randomly-ordered playing cards;

assign a player deck of the plurality of player decks to each of the plurality of players; and, conduct a round of the game including:

initiate a dealing cycle to distribute a player hand to each of the plurality of players, each of the player hands including a plurality of cards being distributed from a corresponding player deck assigned to the player, the dealing cycle including distributing one playing card from a corresponding assigned player deck to each player in a sequential order beginning with a starting player;

detect a triggering condition occurring during the dealing cycle, wherein the triggering condition includes each playing card included in an assigned player deck matching a previously distributed playing card;

when the triggering condition is determined to be met responsively reassemble each assigned player deck by adding each card previously distributed to a player to the corresponding assigned player deck, shuffling each reassembled assigned player deck, and conducting another dealing cycle with the shuffled reassembled player decks to distribute the player hand to each of the plurality of players;

determine an outcome of the round as a function of each of the player hands and provide an award to at least one of the players as a function of the received wagers and the outcome; and remove each corresponding player hand from each corresponding player deck to form a modified player deck and shuffle each modified player deck for use in a subsequent round of the game.

2. A system in accordance with claim 1, the controller configured to:

conduct a plurality of dealing cycles during the round, each dealing cycle including distributing one card to each player hand from the corresponding player deck in a sequential order beginning with a starting player; and for each player hand:

select a first card from a corresponding player deck to be include in the associated player hand;

determine if the selected first card matches each of the cards previously distributed during the dealing cycles; and responsively select another card from the corresponding player deck to replace the first card and to be included in the corresponding player hand if the first card matches a previously distributed card.

3. A system in accordance with claim 1, the controller configured to: display personal player information on the game screen including a rank and a suit of playing cards included in a corresponding player deck.

4. A system in accordance with claim 1, the controller configured to: display a reassembly trigger token on the display screen that allows a player to request a reassembling of a corresponding player deck.

5. A system in accordance with claim 1, wherein the triggering condition further includes at least one of a predetermined card being distributed to at least one player during the corresponding dealing cycle, all playing cards included in the modified player deck being distributed during the corresponding game round, and receiving a request from at least one player to form a reassembled player deck.

6. A system in accordance with claim 1, the controller configured to:

provide a board deck including a set of randomly-ordered playing cards;

distribute a communal hand including one or more cards being distributed from the board deck; and determine an outcome of the round as a function of each of the first player hands and the communal hand.

7. A system in accordance with claim 6, the controller configured to:

determine if a playing card included in the communal hand matches a playing card included in at least one distributed player hand;

replace each matching player hand card with another card; and determine a value of a corresponding player hand as a function of the another card.

8. A system in accordance with claim 1, the controller configured to:

allow at least one player to select a plurality of playing cards to form a personal player deck being assigned to the at least one player;

determine a value of each selected playing card being included in the personal player deck;

determine a deck strength associated with the personal player deck as a function of the value associated with each selected playing card; and display the deck strength of the personal player deck to the corresponding player.

9. A method for operating a system for providing a poker-type card game to a plurality of players, the system including a plurality of user computing devices associated with the plurality of players, a database for storing a plurality of player decks, and a server computer including a controller coupled to each user computing device and the database, each of the user computing devices configured to receive input from a corresponding player and including a display device for displaying the game on a game screen, at least one of the user computing devices including a gaming machine including an acceptor device configured to accept physical media associated with a monetary value to establish a credit balance associated with a player, the controller including a memory device and a processor coupled to the memory device, the memory device including a game program including computer-executable instructions that are executed by the processor, the method including the processor performing the steps of:

receiving a signal from the gaming machine indicating a wager or fee initiated by the player, adjust the credit balance by an amount of the wager or fee, and initiating the game including displaying the game screen on each of the plurality of user computing devices;

accessing the database and retrieving the plurality of player decks, each of the plurality of player decks including a set of randomly-ordered playing cards;

assigning a player deck of the plurality of player decks to each of the plurality of players; and, conducting a round of the game including:

initiating a dealing cycle to distribute a player hand to each of the plurality of players, each of the player hands including a plurality of cards being distributed from a corresponding player deck assigned to the player, the dealing cycle including distributing one playing card from a corresponding assigned player deck to each player in a sequential order beginning with a starting player;

detecting a triggering condition occurring during the dealing cycle, wherein the triggering condition includes each playing card included in an assigned player deck matching a previously distributed playing card;

when the triggering condition is determined to be met responsively reassembling each assigned player deck by adding each card previously distributed to a player to the corresponding assigned player deck, shuffling each reassembled assigned player deck, and conducting another dealing cycle with the shuffled reassembled player decks to distribute the player hand to each of the plurality of players;

determining an outcome of the round as a function of each of the player hands and providing an award to at least one of the players as a function of the received wagers and the outcome; and remove each corresponding player hand from each corresponding player deck to form a modified player deck and shuffle each modified player deck for use in a subsequent round of the game.

10. A method in accordance with claim 9, including the steps of:

conducting a plurality of dealing cycles during the round, each dealing cycle including distributing one card to each player hand from the corresponding player deck in a sequential order beginning with a starting player; and for each player hand:

selecting a card from a corresponding player deck to be include in the associated player hand;

determining if the selected first card matches each of the cards previously distributed during the dealing cycles; and responsively selecting another card from the corresponding player deck to replace the first card and to be included in the corresponding player hand if the first card matches a previously distributed card.

11. A method in accordance with claim 10, including the steps of: displaying a reassembly trigger token on the display screen that allows a player to request a reassembling of a corresponding player deck.

12. A method in accordance with claim 9, including the steps of: displaying personal player information on the game screen including a rank and a suit of playing cards included in a corresponding player deck.

13. A method in accordance with claim 9, including the steps of:

providing a board deck including a set of randomly-ordered playing cards;

distributing a communal hand including one or more cards being distributed from the board deck; and determining an outcome of the round as a function of each of the first player hands and the communal hand.

14. A method in accordance with claim 13, including the steps of:

determining if a playing card included in the communal hand matches a playing card included in at least one distributed player hand;

replacing each matching player hand card with another card; and determining a value of a corresponding player hand as a function of the another card.

15. A method in accordance with claim 9, including the steps of:

allowing at least one player to select a plurality of playing cards to form a personal player deck being assigned to the at least one player;

determining a value of each selected playing card being included in the personal player deck;

determining a deck strength associated with the personal player deck as a function of the value associated with each selected playing card; and displaying the deck strength of the personal player deck to the corresponding player.

16. One or more non-transitory computer-readable storage media, having computer-executable instructions embodied thereon, wherein when executed by at least one processor, the computer-executable instructions cause the processor to:

receive requests to initiate a game from a plurality of user computing devices associated with the plurality of players, each of the user computing devices configured to receive input from a corresponding player and including a display device for displaying game on a game screen, at least one of the user computing devices including a gaming machine including an acceptor device configured to accept physical media associated with a monetary value to establish a credit balance associated with a player;

receive a signal from the gaming machine indicating a wager or fee initiated by the player, adjust the credit balance by an amount of the wager or fee, and initiate the game and display the game on and display the game on on each of the plurality of user computing devices;

access a database and retrieve a plurality of player decks being stored in the database, each of the plurality of player decks including a set of randomly-ordered playing cards;

assign a player deck of the plurality of player decks to each of the plurality of players; and, conduct a round of the game including:

initiate a dealing cycle to distribute a player hand to each of the plurality of players, each of the player hands including a plurality of cards being distributed from a corresponding player deck assigned to the player, the dealing cycle including distributing one playing card from a corresponding assigned player deck to each player in a sequential order beginning with a starting player;

detect a triggering condition occurring during the dealing cycle, wherein the triggering condition includes each playing card included in an assigned player deck matching a previously distributed playing card;

when the triggering condition is determined to be met responsively reassemble each assigned player deck by adding each card previously distributed to a player to the corresponding assigned player deck, shuffling each reassembled assigned player deck, and conducting another dealing cycle with the shuffled reassembled player decks to distribute the player hand to each of the plurality of players;

determine an outcome of the round as a function of each of the player hands and provide an award to at least one of the players as a function of the received wagers and the outcome; and remove each corresponding player hand from each corresponding player deck to form a modified player deck and shuffle each modified player deck for use in a subsequent round of the game.

17. The one or more computer-readable storage media according to claim 16, wherein when executed by at least one processor, the computer-executable instructions cause the processor to:

conduct a plurality of dealing cycles during the round, each dealing cycle including distributing one card to each player hand from the corresponding player deck in a sequential order beginning with a starting player; and for each player hand:

select a first card from a corresponding player deck to be include in the associated player hand;

determine if the selected first card matches each of the cards previously distributed during the dealing cycles; and responsively select another card from the corresponding player deck to replace the first card and to be included in the corresponding player hand if the first card matches a previously distributed card.

18. The one or more computer-readable storage media according to claim 16, wherein when executed by at least one processor, the computer-executable instructions cause the processor to: display personal player information on the game screen including a rank and a suit of playing cards included in a corresponding player deck.

19. The one or more computer-readable storage media according to claim 16, wherein when executed by at least one processor, the computer-executable instructions cause the processor to: display a reassembly trigger token on the display screen that allows a player to request a reassembling of a corresponding player deck.

20. The one or more computer-readable storage media according to claim 16, wherein when executed by at least one processor, the computer-executable instructions cause the processor to:

allow at least one player to select a plurality of playing cards to form a personal player deck being assigned to the at least one player;

determine a value of each selected playing card being included in the personal player deck;

determine a deck strength associated with the personal player deck as a function of the value associated with each selected playing card; and display the deck strength of the personal player deck to the corresponding player.

* * * * *